US010363762B2

(12) United States Patent
Takabayashi

(10) Patent No.: US 10,363,762 B2
(45) Date of Patent: Jul. 30, 2019

(54) LIQUID EJECTING APPARATUS

(71) Applicant: SEIKO EPSON CORPORATION, Tokyo (JP)

(72) Inventor: Kazunori Takabayashi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/843,646

(22) Filed: Dec. 15, 2017

(65) Prior Publication Data

US 2018/0178567 A1 Jun. 28, 2018

(30) Foreign Application Priority Data

Dec. 27, 2016 (JP) ..... 2016-254016

(51) Int. Cl.

| | |
|---|---|
| ***B41J 29/02*** | (2006.01) |
| ***B41J 13/10*** | (2006.01) |
| ***B41J 2/175*** | (2006.01) |
| ***B41J 29/13*** | (2006.01) |
| *B41J 2/01* | (2006.01) |

(52) U.S. Cl.

CPC ..... *B41J 29/02* (2013.01); *B41J 2/1752* (2013.01); *B41J 2/17509* (2013.01); *B41J 2/17513* (2013.01); *B41J 2/17553* (2013.01); *B41J 13/106* (2013.01); *B41J 29/13* (2013.01); *B41J 2/01* (2013.01)

(58) Field of Classification Search

CPC ..... B41J 29/02; B41J 2/01
USPC ..... 347/108
See application file for complete search history.

(56) References Cited

U.S. PATENT DOCUMENTS

2005/0088493 A1* 4/2005 Koga ..... B41J 2/17509 347/85
2005/0099454 A1* 5/2005 Silverbrook ..... B41J 3/36 347/42
2007/0070147 A1* 3/2007 Hattori ..... B41J 2/17506 347/86
2013/0155450 A1* 6/2013 Higashikawa ..... B41J 2/1752 358/1.15
2014/0043409 A1* 2/2014 Suzuki ..... B41J 2/17553 347/86
2014/0104349 A1* 4/2014 Kimura ..... B41J 2/17509 347/85
2015/0124028 A1 5/2015 Kimura et al.
(Continued)

FOREIGN PATENT DOCUMENTS

JP 2014-079908 A 5/2014

*Primary Examiner* — Huan H Tran
*Assistant Examiner* — Alexander D Shenderov
(74) *Attorney, Agent, or Firm* — Workman Nydegger

(57) ABSTRACT

A liquid ejecting apparatus includes a liquid ejecting unit that ejects a liquid to a medium, a liquid storage unit including at least one liquid container for storing the liquid and located on a front side of the apparatus, an operation panel located on the front side of the apparatus, and through which operations are inputted, and a medium output tray located on the front side of the apparatus to receive the medium discharged. The liquid storage unit and the medium output tray are both protruding forward with respect to the operation panel. The liquid storage unit includes a pivotal cover that opens and closes at least a part of the liquid container, a lock unit that locks the cover with a lock device when the cover is closed, and a lock device mounting base on which the lock device is mounted.

11 Claims, 22 Drawing Sheets

(56) References Cited

U.S. PATENT DOCUMENTS

| | | | | |
|---|---|---|---|---|
| 2015/0283816 | A1 | 10/2015 | Kimura et al. | |
| 2015/0352853 | A1* | 12/2015 | Kudo | B41J 2/175 347/86 |
| 2016/0200111 | A1 | 7/2016 | Kimura et al. | |

* cited by examiner

LIQUID EJECTING APPARATUS

BACKGROUND

1. Technical Field

The present invention relates to a liquid ejecting apparatus that ejects a liquid.

2. Related Art

Liquid ejecting apparatuses that eject a liquid include an ink jet printer. The ink jet printer includes a recording head constituting a liquid ejecting unit that ejects ink, an example of the liquid.

In some of the ink jet printers, an ink container for storing the ink is located away from the liquid ejecting unit. In this case, the ink container and the liquid ejecting unit are connected via a tube for supplying the ink.

For example, JP-A-2014-79908 discloses a printer in which an ink tank (corresponding to the ink container) is provided on a front side of the apparatus, and enclosed inside a cover. In this printing apparatus, the ink tank is accommodated inside a casing that forms the overall appearance of the apparatus, so as not to protrude from the side face of the apparatus, from the viewpoint of good appearance.

In the ink jet printer according to JP-A-2014-79908, the ink can be replenished from a bottle to the ink tank. In this relation, there is a demand for an ink tank having a larger capacity that enables a larger number of sheets to be printed, with each refill of the ink. For this purpose, however, the size of the ink tank has to be increased, and the ink tank may inevitably be designed so as to protrude forward, at least from an operation panel provided on the front face of the apparatus. In such a case, a protruding portion and a recessed portion are formed in the front side of the apparatus, which is undesirable from the viewpoint of appearance. Moreover, in the case where only the ink tank is protruding from the front side of the apparatus, the ink tank may, for example, bump against a wall and be damaged, while the apparatus is being transported.

SUMMARY

An advantage of some aspects of the invention is provision of a liquid ejecting apparatus having an ink tank with an increased capacity, yet capable of maintaining good appearance and strength.

In an aspect, the invention provides a liquid ejecting apparatus including a liquid ejecting unit that ejects a liquid to a medium, a liquid storage unit including at least one liquid container for storing the liquid and located on a front side of the apparatus, an operation panel through which operations are inputted, and a medium output tray located on the front side of the apparatus to receive the medium discharged. The liquid storage unit and the medium output tray are both protruding forward with respect to the operation panel.

In the liquid ejecting apparatus thus configured, the liquid storage unit and the medium output tray located on the front side of the apparatus are both protruding forward with respect to the operation panel. Such a configuration provides both better appearance and higher strength, compared with the case where only either of the liquid storage unit and the medium output tray is protruding from the operation panel.

In another aspect, the invention provides a liquid ejecting apparatus including a liquid ejecting unit that ejects a liquid to a medium, a liquid storage unit including at least one liquid container for storing the liquid and located on a front side of the apparatus, an operation panel through which operations are inputted, and a medium storage unit configured to receive the medium from the front side of the apparatus. The liquid storage unit and the medium storage unit are both protruding forward with respect to the operation panel.

In the liquid ejecting apparatus thus configured, the liquid storage unit and the medium storage unit located on the front side of the apparatus are both protruding forward with respect to the operation panel. Such a configuration provides both better appearance and higher strength, compared with the case where only either of the liquid storage unit and the medium storage unit is protruding from the operation panel.

In the foregoing liquid ejecting apparatus, the liquid storage unit may include a pivotal cover that opens and closes at least a part of the liquid container, a lock unit that locks the cover with a lock device when the cover is closed, and a lock device mounting base on which the lock device is mounted.

In the liquid ejecting apparatus thus configured, the liquid storage unit includes the pivotal cover that opens and closes at least a part of the liquid container, the lock unit that locks the cover with a lock device when the cover is closed, and the lock device mounting base on which the lock device is mounted. The mentioned configuration allows the cover to be locked in a closed state, thereby preventing an accidental access to the liquid container.

The foregoing liquid ejecting apparatus may further include an image reading unit configured to read an image and located on an upper side of a main body including the liquid ejecting unit. The image reading unit may be located so as to open and close the upper side of the main body, and cover the lock device mounting base in a closed state.

In this case, the liquid ejecting apparatus includes the image reading unit configured to read an image and located on the upper side of the main body including the liquid ejecting unit, and the image reading unit is located so as to open and close the upper side of the main body, and cover the lock device mounting base in a closed state. The mentioned configuration allows the lock device to be hidden when the image reading unit is closed, thereby improving the appearance of the liquid ejecting apparatus.

In the foregoing liquid ejecting apparatus, the liquid container may include a liquid inlet port through which the liquid can be received from a liquid supply container. The liquid storage unit may include a plurality of the liquid containers, an upper housing provided on an upper side of the liquid container, and a pivotal cover that opens and closes an upper side of the upper housing. The upper housing may delimit an upper position of the liquid container, and include a mislocation prevention device that prevents mislocation of the liquid supply container on a corresponding one of a plurality of the liquid inlet ports, and a pivotal shaft of the cover.

With the mentioned configuration, the upper housing provided on the upper side of the liquid storage unit serves to delimit the upper position of the liquid container, and prevent mislocation of the liquid supply container on a corresponding one of the plurality of liquid inlet ports, and also serves as the pivotal shaft of the cover. Thus, the mentioned functions can be realized by a single component, which leads to reduction in number of parts, hence to reduction in cost.

The foregoing liquid ejecting apparatus may further include a lower frame forming a part of a bottom portion of the main body, the lower frame constituting a bottom portion of a storage compartment in which the liquid container is accommodated in the liquid storage unit. The liquid ejecting apparatus may also include a reinforcing frame constituting a top face and an inner wall of the storage compartment. The top face and the upper housing may be fixed to each other, and the reinforcing frame and the lower frame may be fixed to each other.

With the mentioned configuration, the reinforcing frame contributes to improving the rigidity of the liquid storage unit, and allows the upper housing to be more securely fixed.

In the foregoing liquid ejecting apparatus, the liquid container may include the liquid inlet port through which the liquid can be received from the liquid supply container. The liquid inlet port may be located between a front face of the liquid storage unit and a front face of the operation panel, in a depth direction of the apparatus, when the operation panel is retracted.

Locating thus the liquid inlet port, through which the liquid can be received from the liquid supply container, between the front face of the liquid storage unit and the front face of the operation panel in a depth direction of the apparatus, assures that both good appearance and sufficient strength of the apparatus can be attained.

In the foregoing liquid ejecting apparatus, the liquid container may include the liquid inlet port through which the liquid can be received from the liquid supply container. The liquid storage unit may include an air release port provided in a buffer section connected to the liquid container, a pivotal cover that opens and closes an upper side of the liquid inlet port and the air release port, and a detector that detects the opening and closing of the cover. The detector may be located outside a region where the liquid inlet port and the air release port are provided.

Locating thus the detector outside the region where the liquid inlet port and the air release port are provided assures that both good appearance and sufficient strength of the apparatus can be attained.

The foregoing liquid ejecting apparatus may further include the image reading unit configured to read an image and located on the upper side of the main body including the liquid ejecting unit. A front face of the image reading unit and the front face of the operation panel may be flush with each other, when the image reading unit is closed.

In the mentioned configuration, in which the image reading unit that reads an image is located on the upper side of the main body including the liquid ejecting unit, the front face of the image reading unit and the front face of the operation panel are flush with each other, when the image reading unit is closed. Therefore, the appearance of the liquid ejecting apparatus can be further improved.

In the foregoing liquid ejecting apparatus, a side face of the liquid storage unit and a side face of the apparatus may be flush with each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, exemplary embodiments of the invention will be described with reference to the drawings. The same elements employed in common in the embodiments will only be described with reference to a first embodiment in which such elements are referred to, and the description thereof will not be repeated in the subsequent embodiments.

Figure 1:
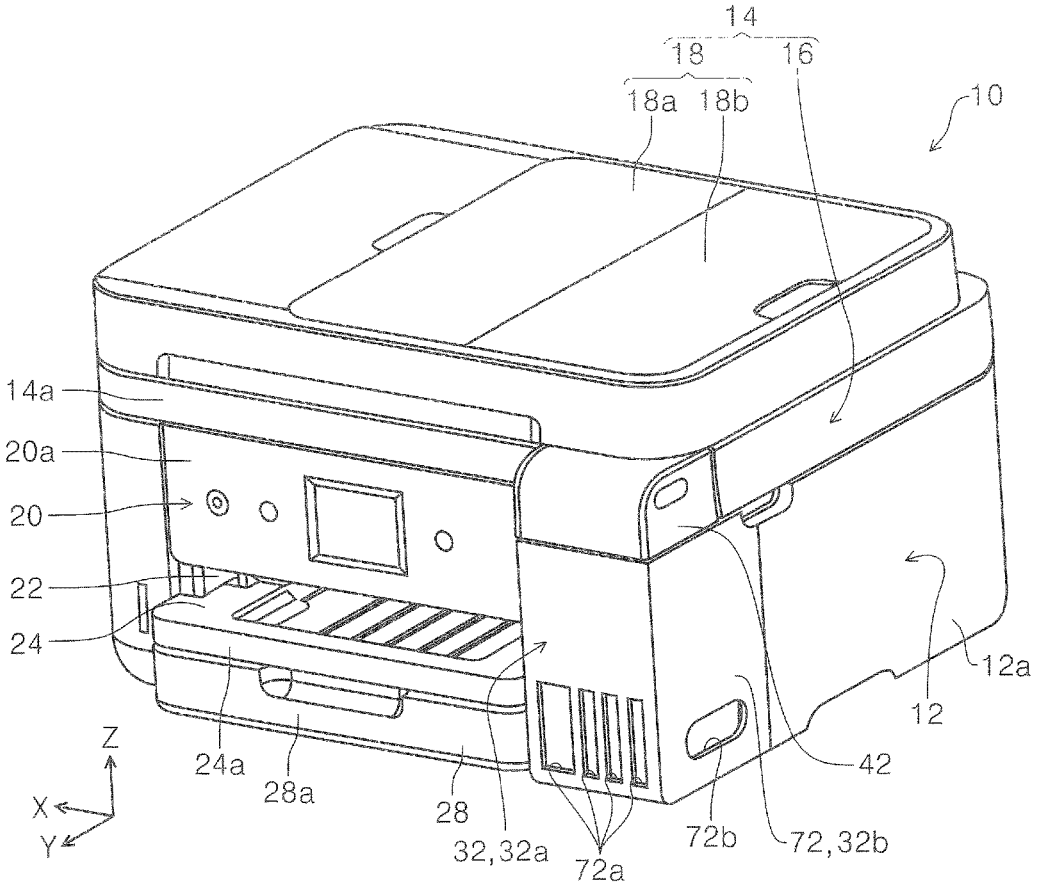
FIG. 1 is a perspective view showing an appearance of a printer according to the invention, in which an ADF is not in operation.
Figure 2:
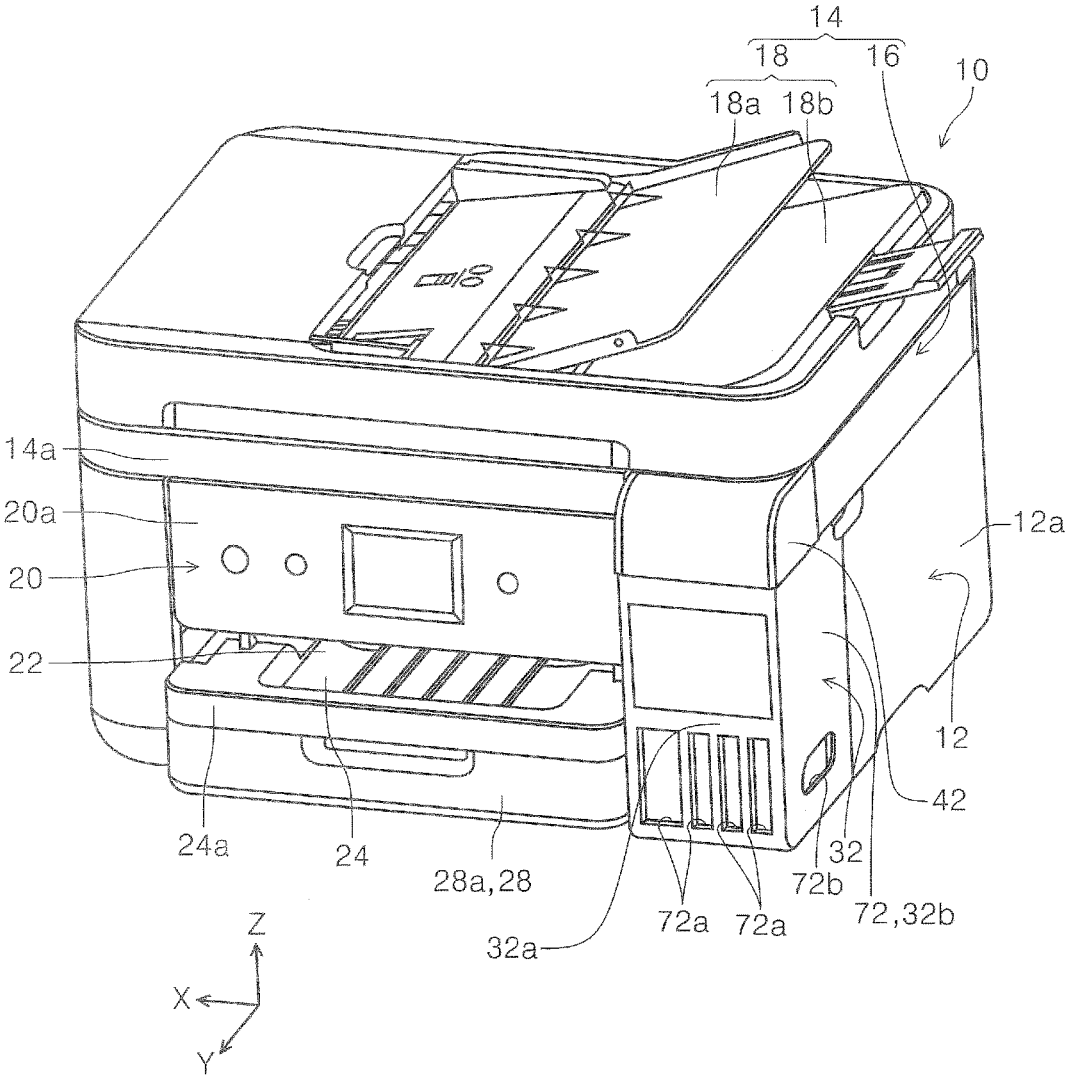
FIG. 2 is a perspective view showing an appearance of the printer according to the invention, in which the ADF is in operation.
Figure 3:
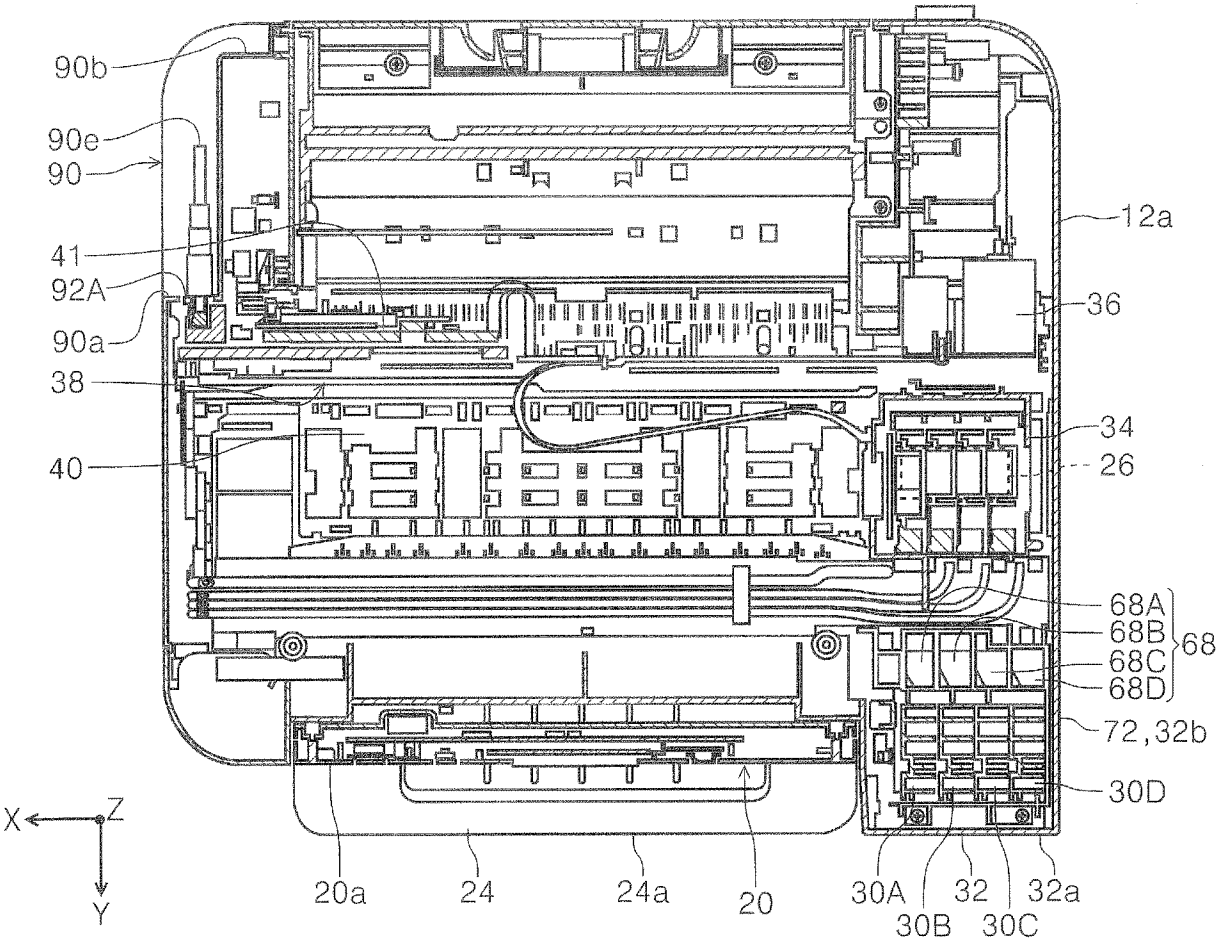
FIG. 3 is a cross-sectional view of the printer according to the invention, viewed from above.
Figure 4:
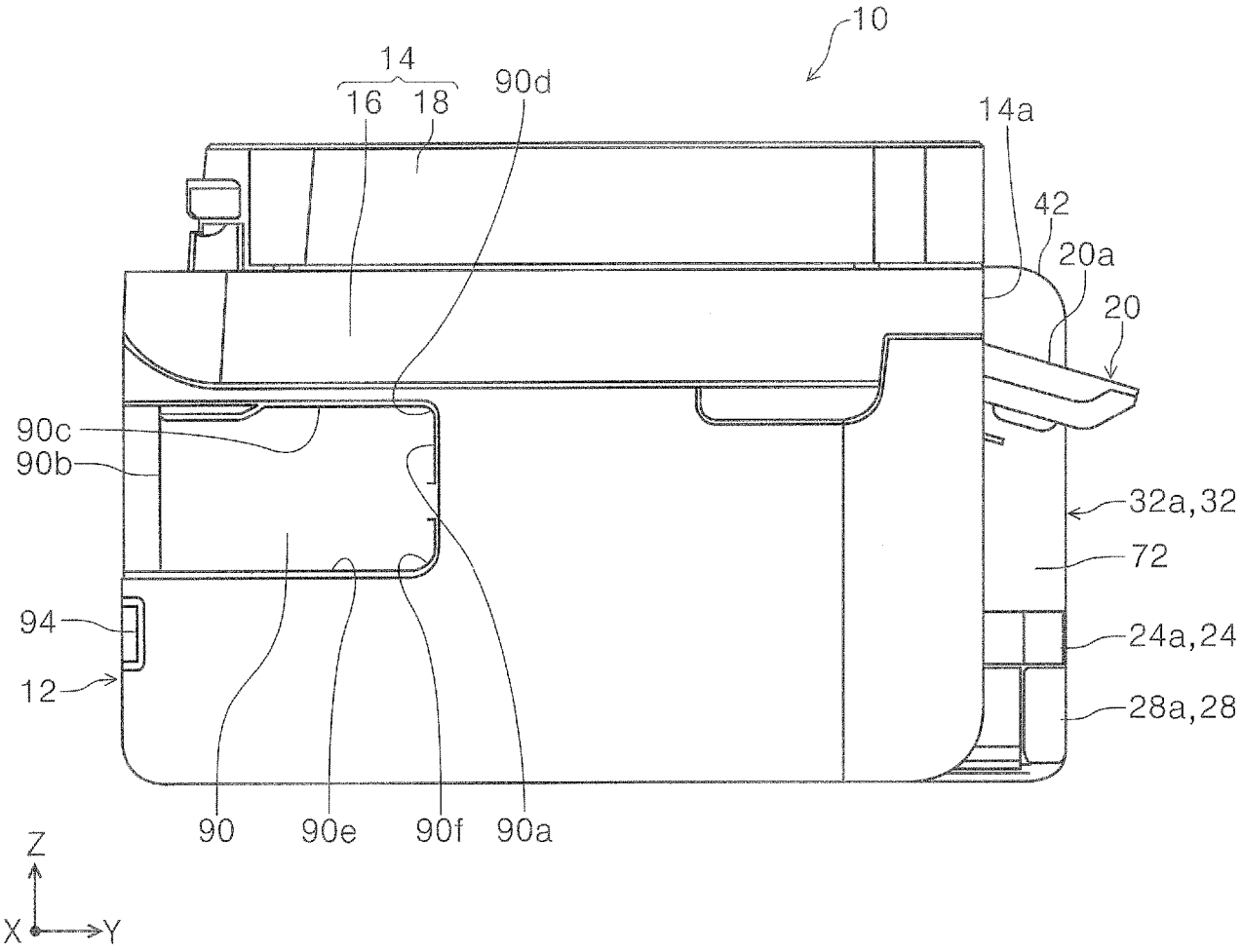
FIG. 4 is a side view of printer according to the invention.
Figure 5:
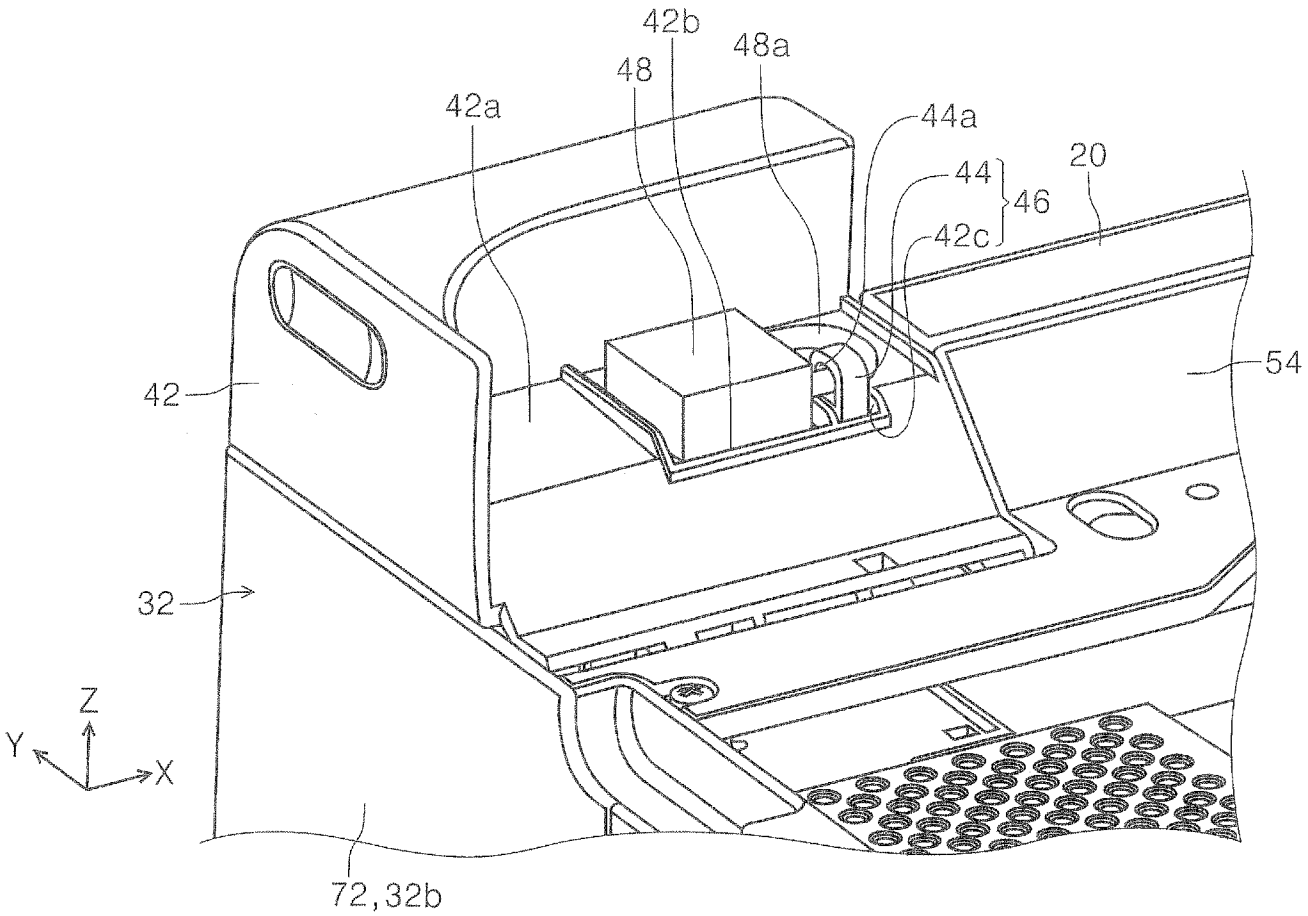
FIG. 5 is a perspective view showing an appearance of a lock device mounting base and a lock device of the printer according to the invention.
Figure 6:
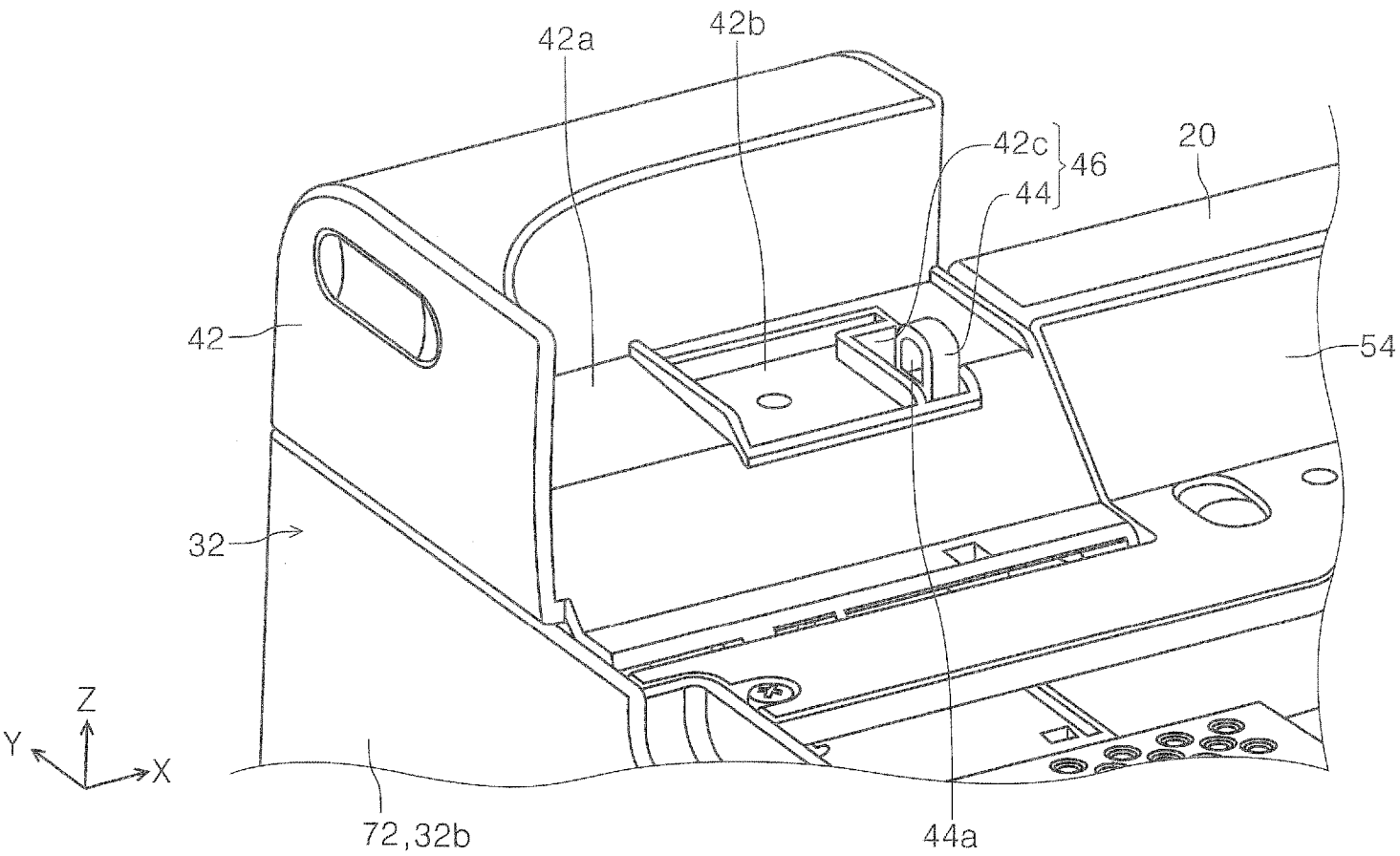
FIG. 6 is a perspective view showing an appearance of the lock device mounting base of the printer according to the invention.
Figure 7:
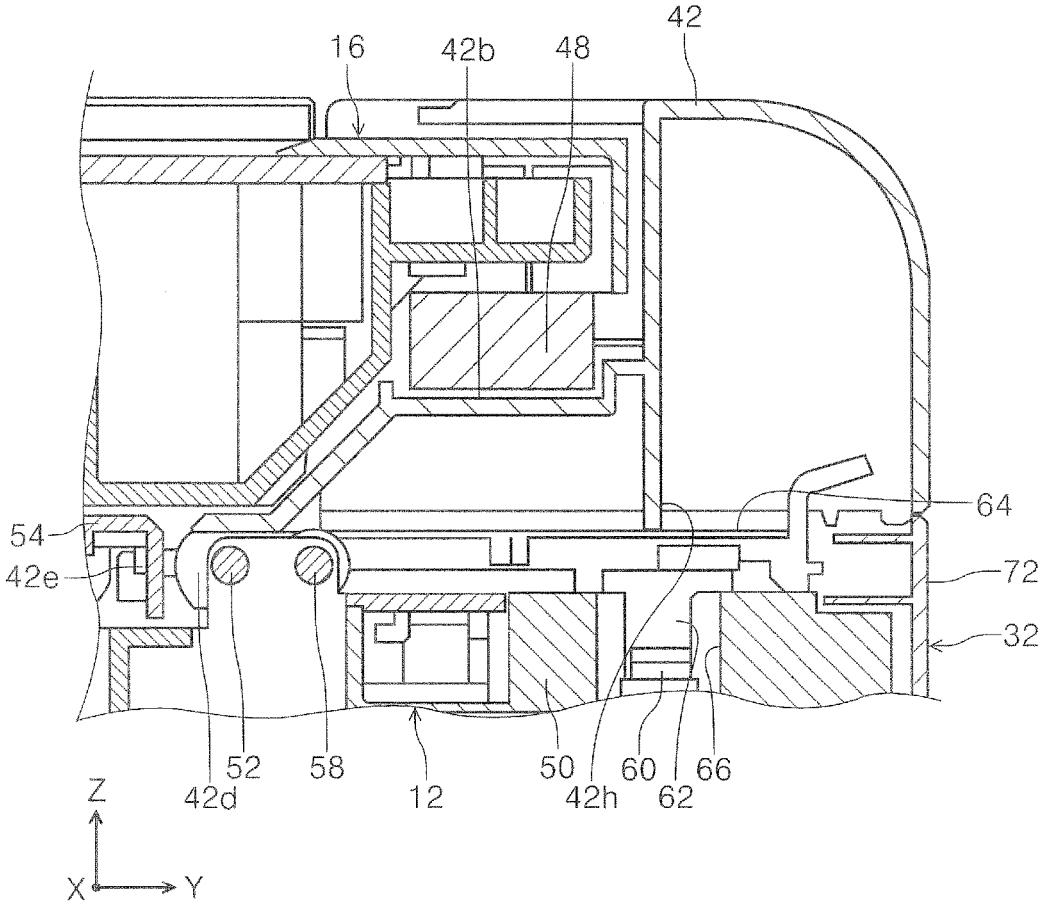
FIG. 7 is a side cross-sectional view of the lock device mounting base and the lock device of the printer according to the invention, covered with a scanner main body in a closed state.

FIG. 1 is a perspective view showing an appearance of a printer according to the invention, in which an ADF is not in operation; FIG. 2 is a perspective view showing an appearance of the printer according to the invention, in which the ADF is in operation; FIG. 3 is a cross-sectional view of the printer according to the invention, viewed from above; FIG. 4 is a side view of printer according to the invention; FIG. 5 is a perspective view showing an appearance of a lock device mounting base and a lock device of the printer according to the invention; FIG. 6 is a perspective view showing an appearance of the lock device mounting base of the printer according to the invention; and FIG. 7 is a side cross-sectional view of the lock device mounting base and the lock device of the printer according to the invention, covered with a scanner main body in a closed state.

Figure 8:
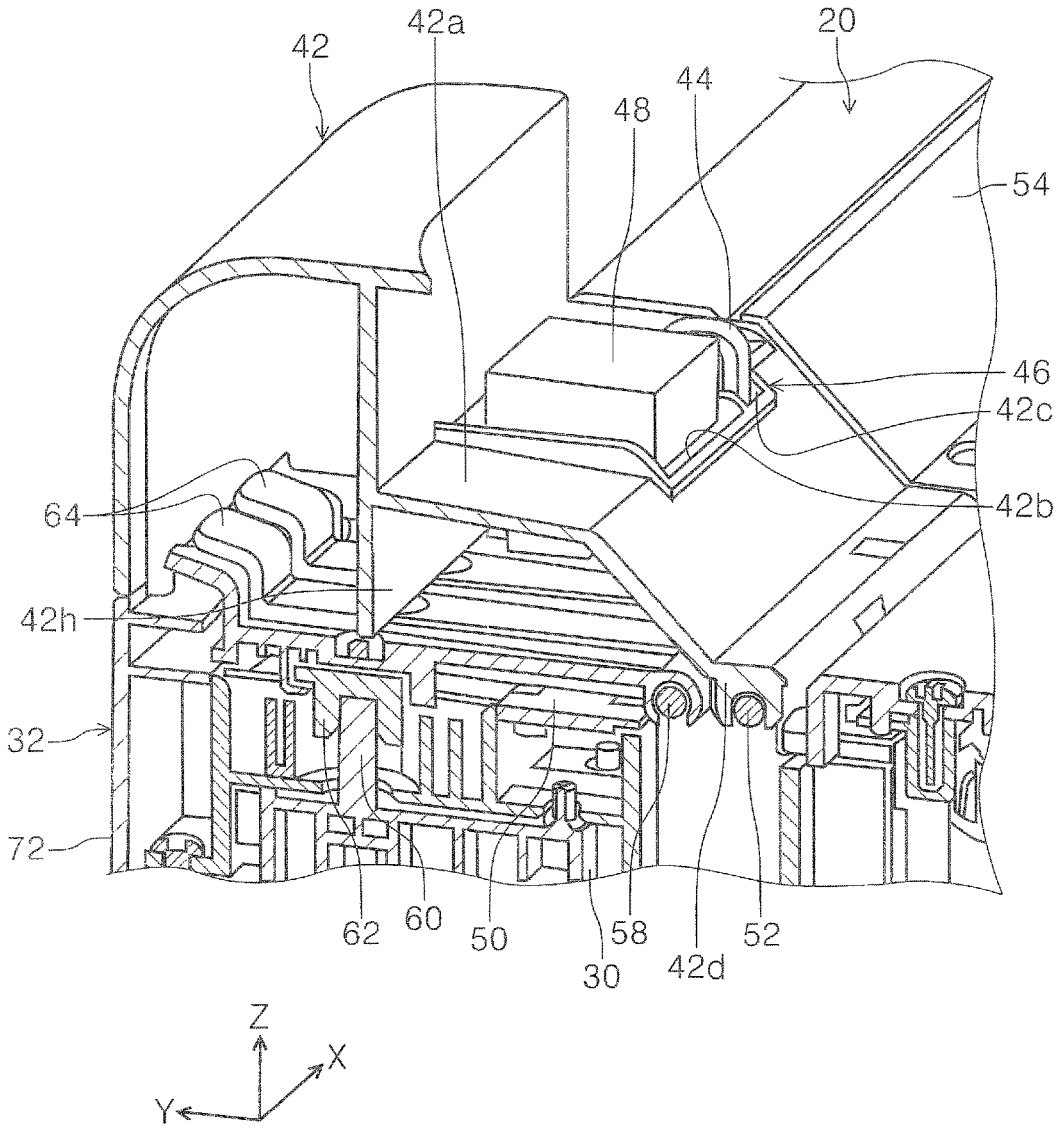
FIG. 8 is a partially cut-away perspective view showing an ink storage unit covered with an ink storage unit cover.
Figure 9:
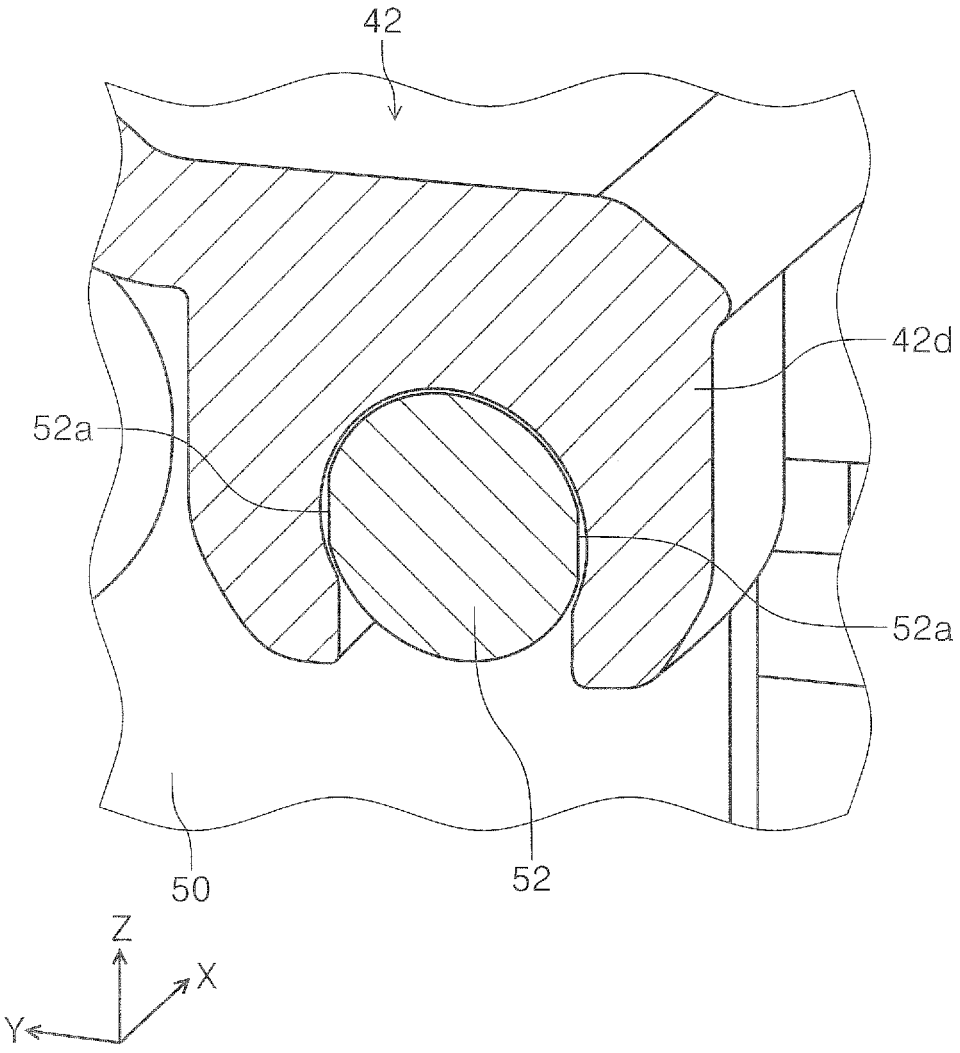
FIG. 9 is a partially cut-away perspective view showing a pivotal shaft of the ink storage unit cover.
Figure 10:
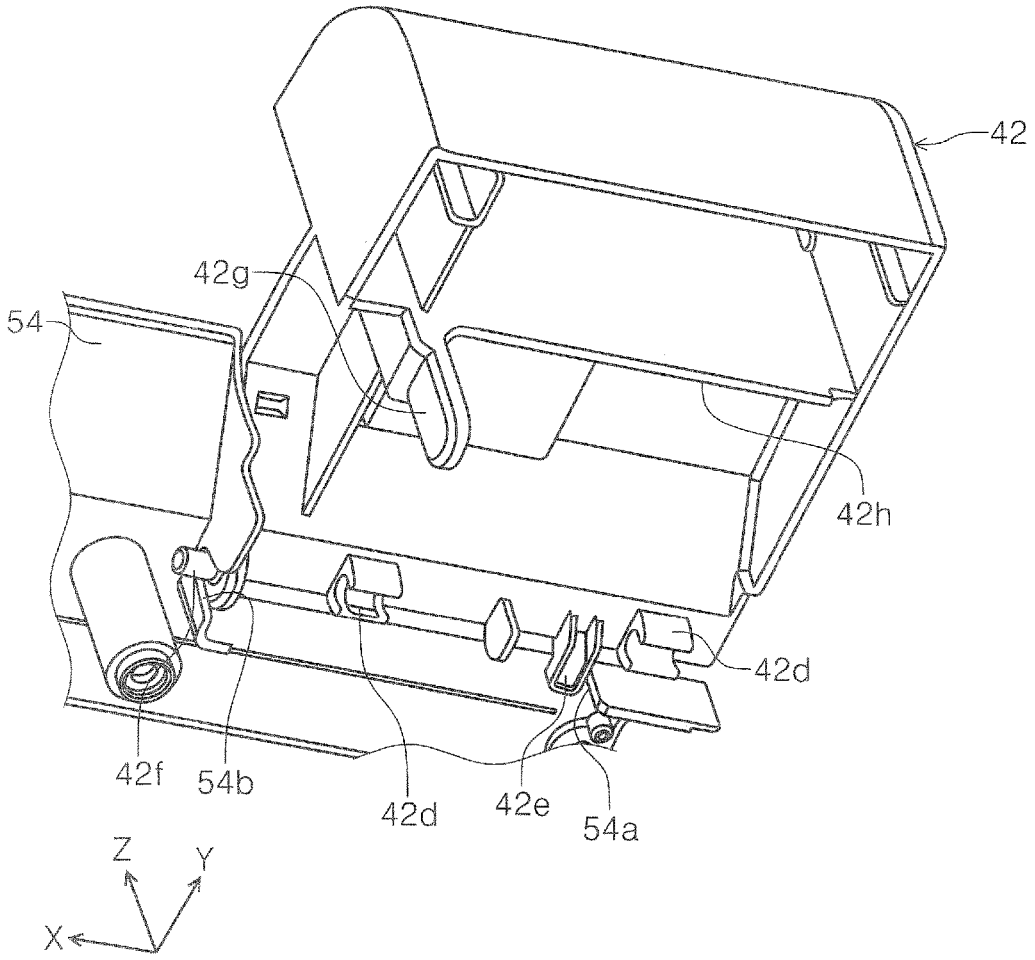
FIG. 10 is a perspective view showing the ink storage unit cover, viewed from below.
Figure 11:
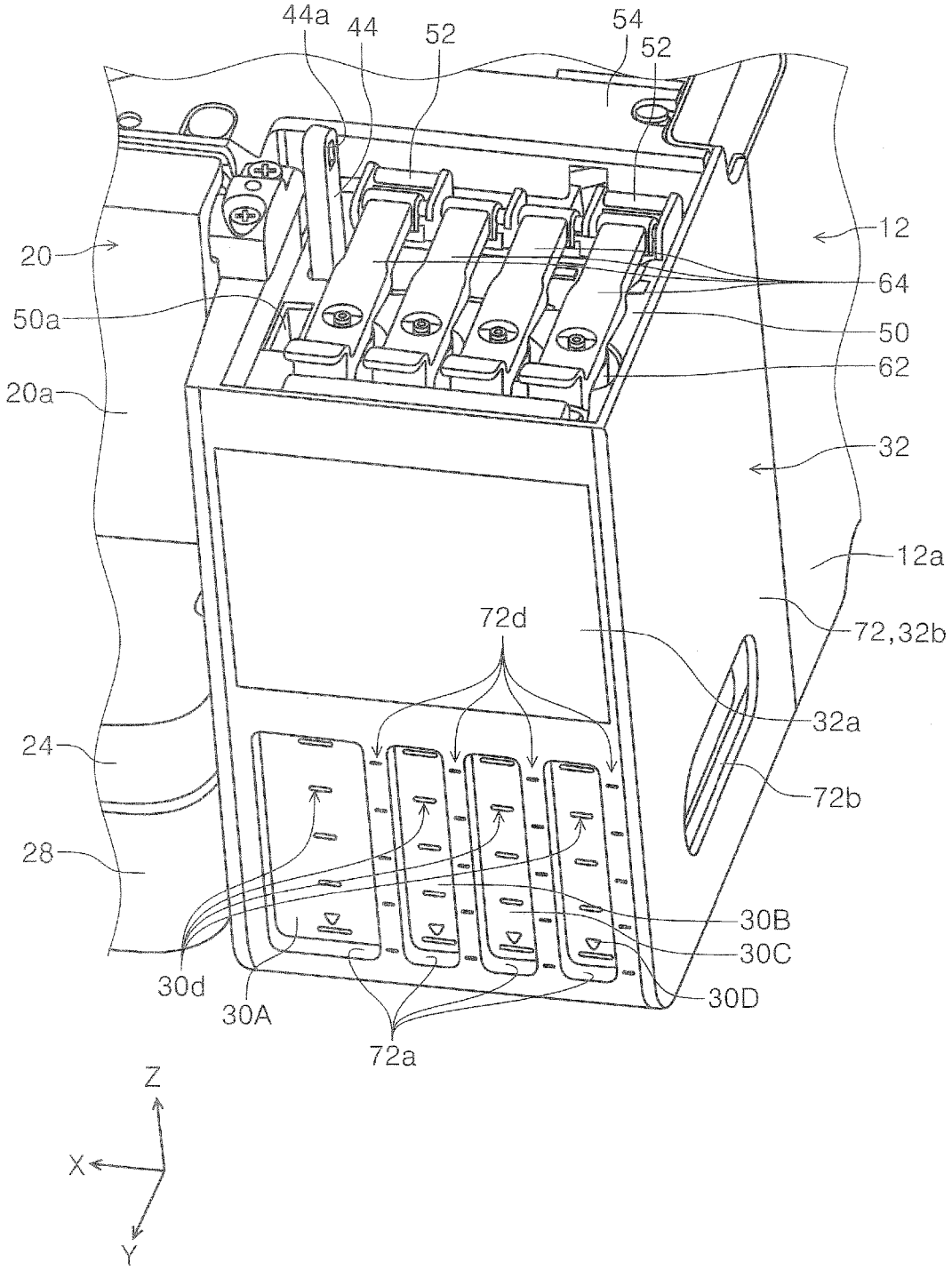
FIG. 11 is a perspective view showing the ink storage unit, with the ink storage unit cover removed.
Figure 12:
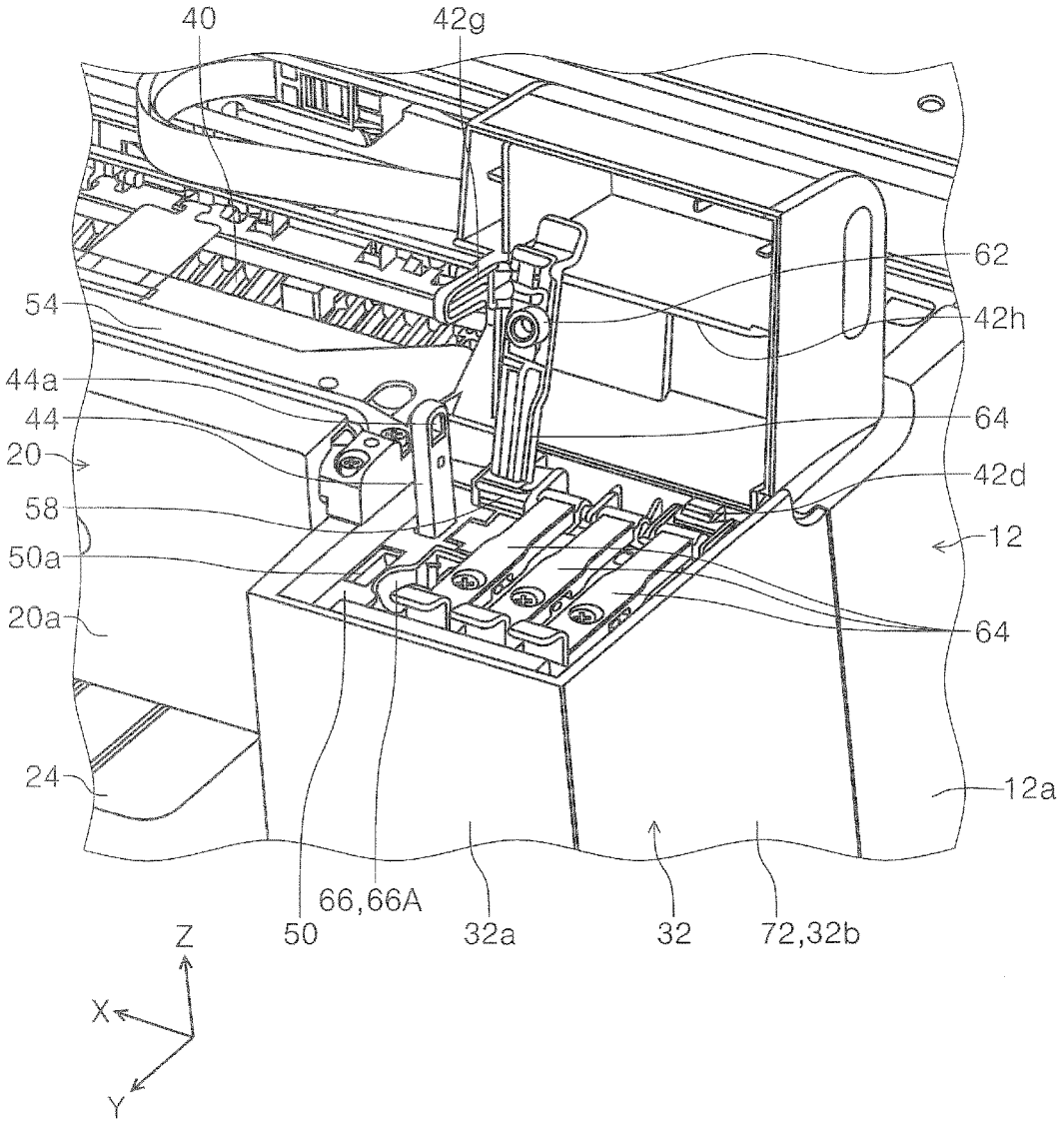
FIG. 12 is a perspective view showing the ink storage unit, in which a lock lever is opened.
Figure 13:
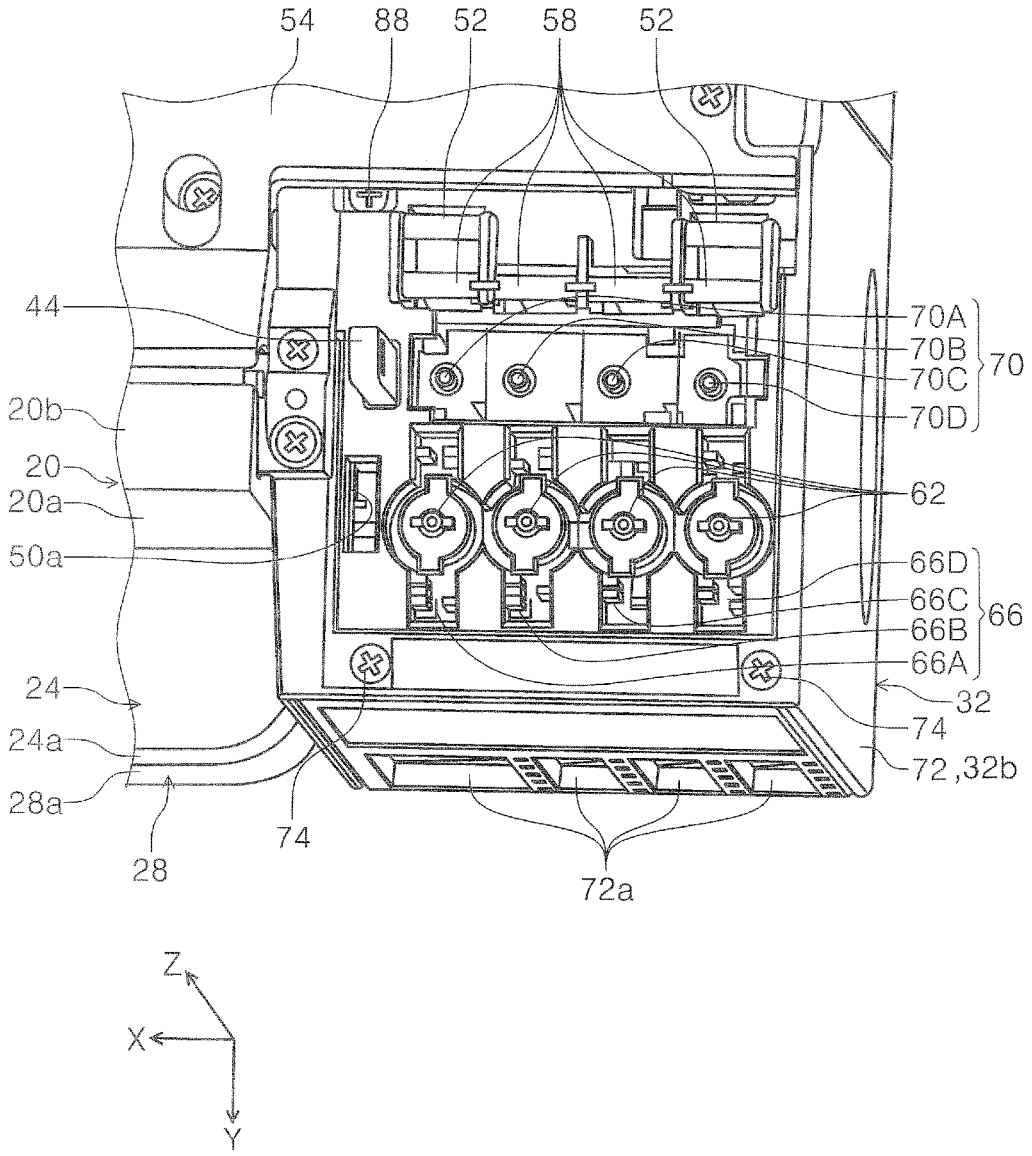
FIG. 13 is a perspective view showing an ink inlet port of the ink storage unit and an air release port of a buffer section.
Figure 14:
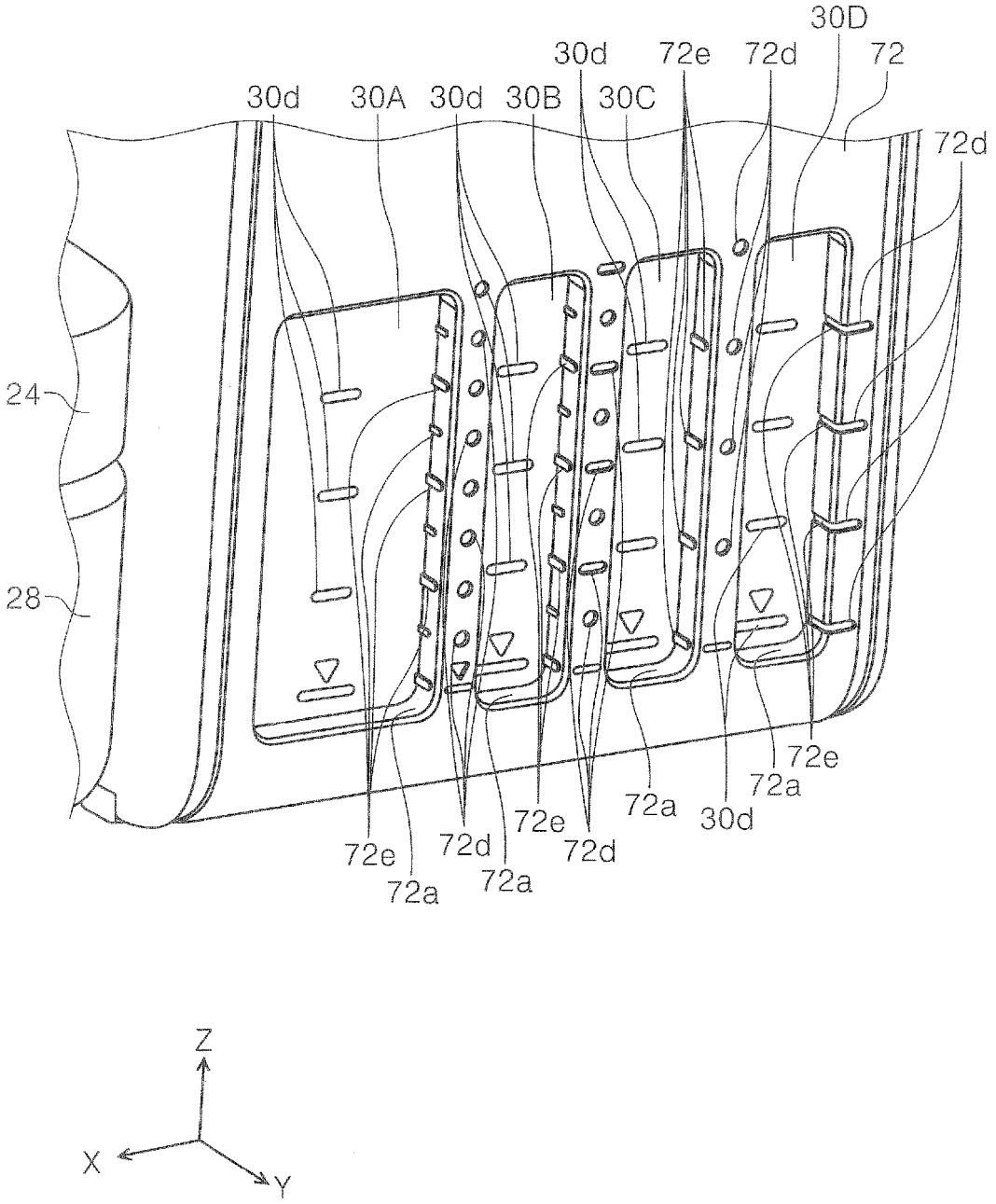
FIG. 14 is a perspective view showing an ink balance indicator of an ink tank, provided at a lower portion of the ink storage unit.

FIG. 8 is a partially cut-away perspective view showing an ink storage unit covered with an ink storage unit cover; FIG. 9 is a partially cut-away perspective view showing a pivotal shaft of the ink storage unit cover; FIG. 10 is a perspective view showing the ink storage unit cover, viewed from below; FIG. 11 is a perspective view showing the ink storage unit, with the ink storage unit cover removed; FIG. 12 is a perspective view showing the ink storage unit, in which a lock lever is opened; FIG. 13 is a perspective view showing an ink inlet port of the ink storage unit and an air release port of a buffer section; and FIG. 14 is a perspective view showing an ink balance indicator of an ink tank, provided at a lower portion of the ink storage unit.

Figure 15:
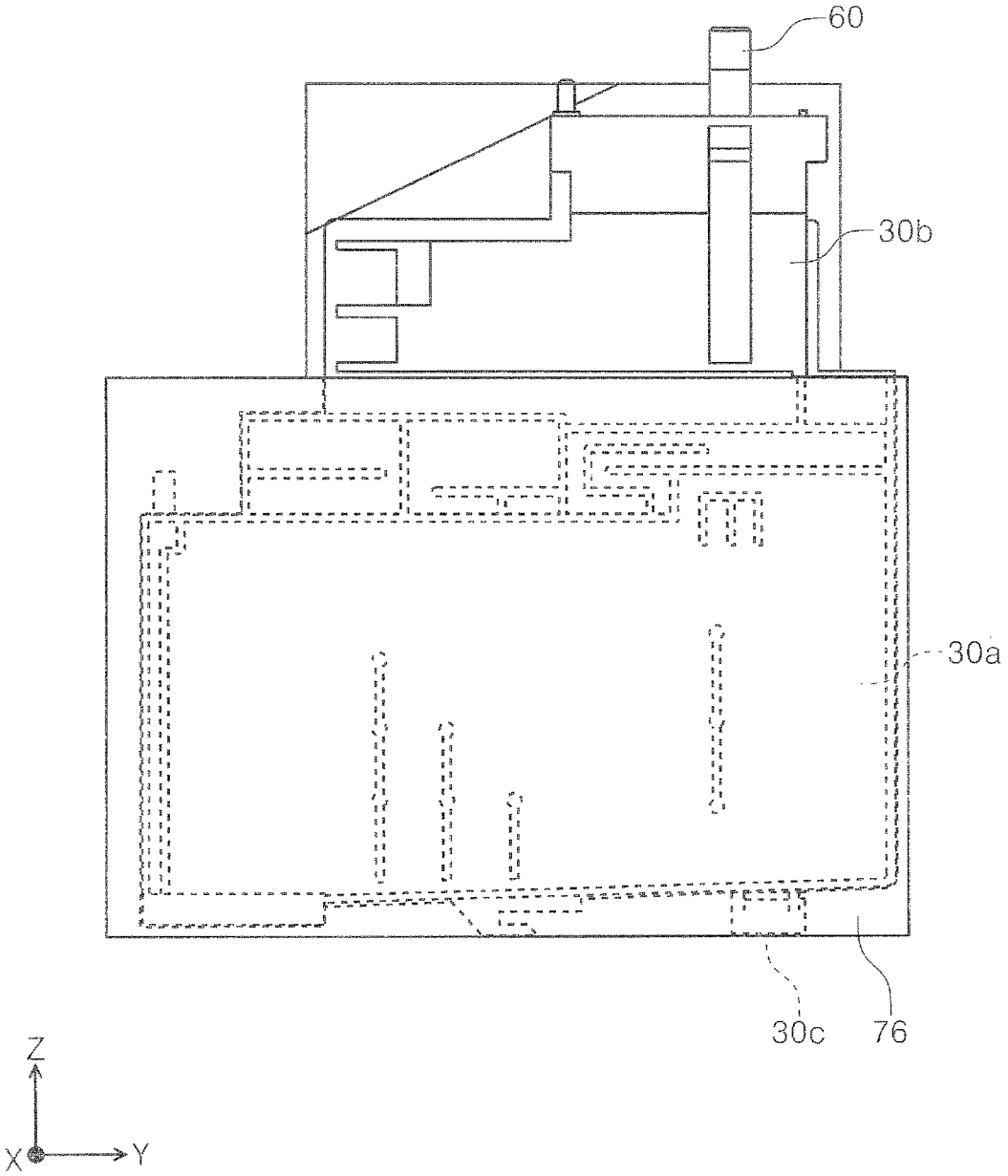
FIG. 15 is a side view of the ink tank.
Figure 16:
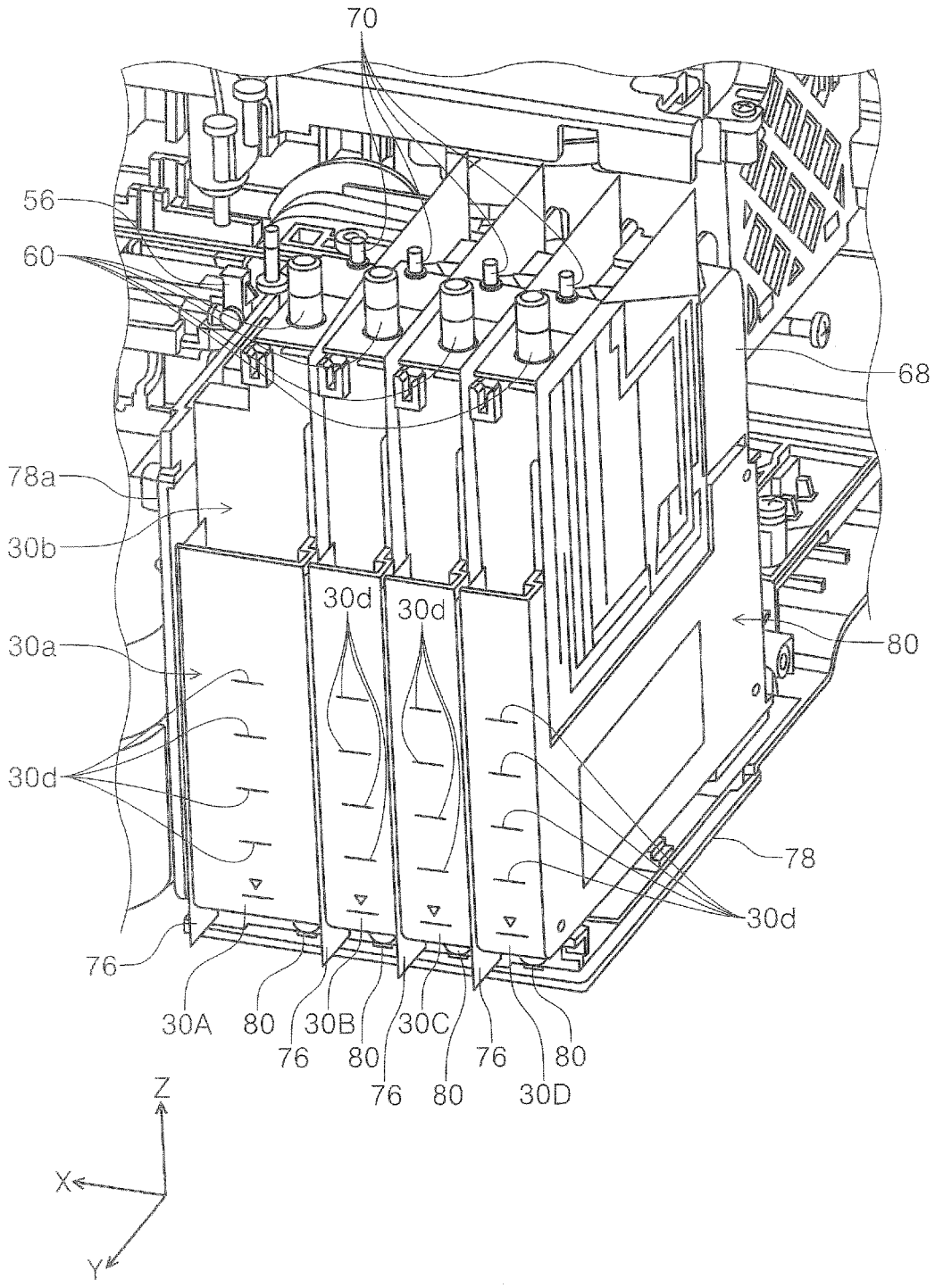
FIG. 16 is a perspective view showing the ink storage unit, with a reinforcing frame removed.
Figure 17:
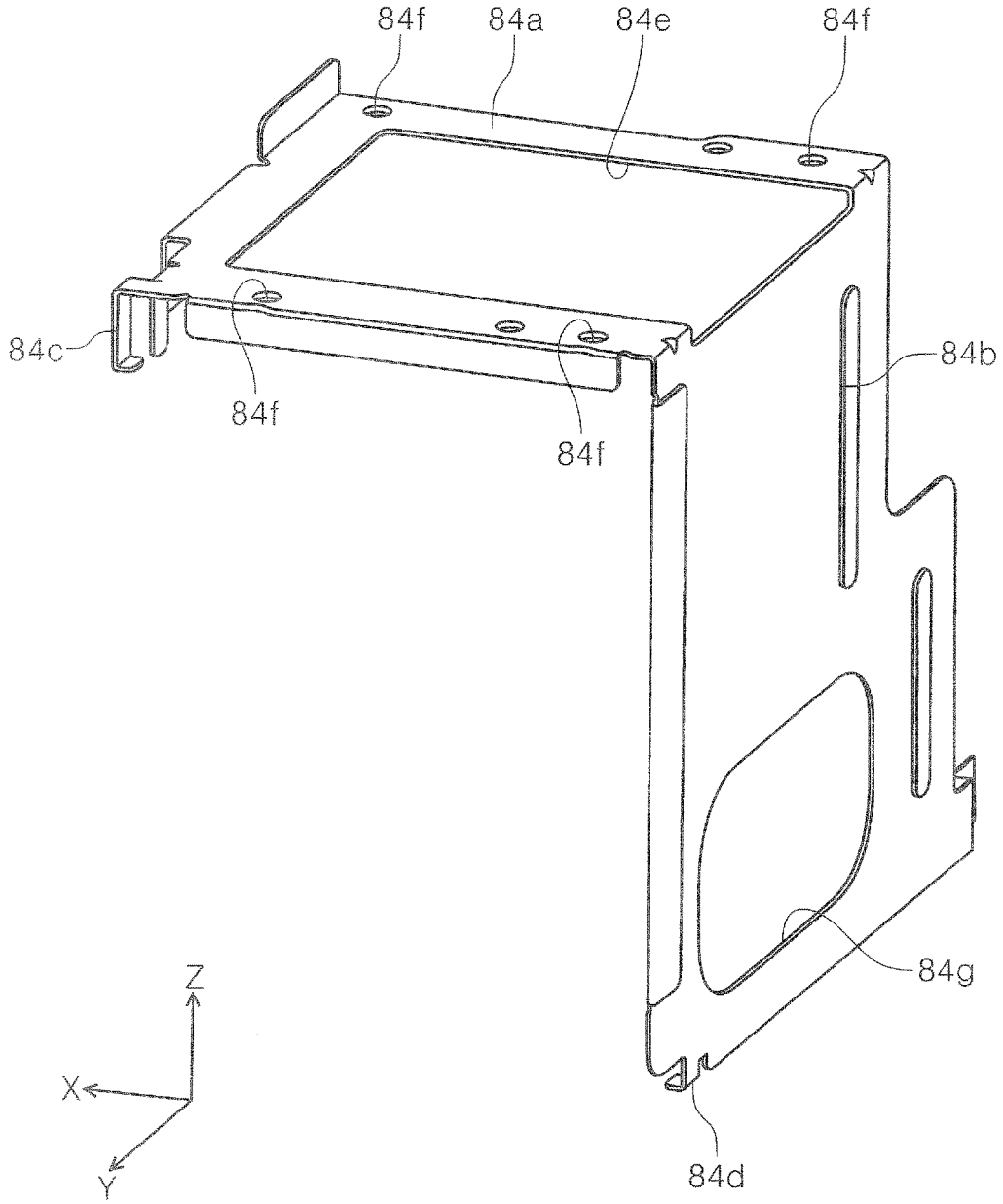
FIG. 17 is a perspective view showing an appearance of the reinforcing frame.
Figure 18:
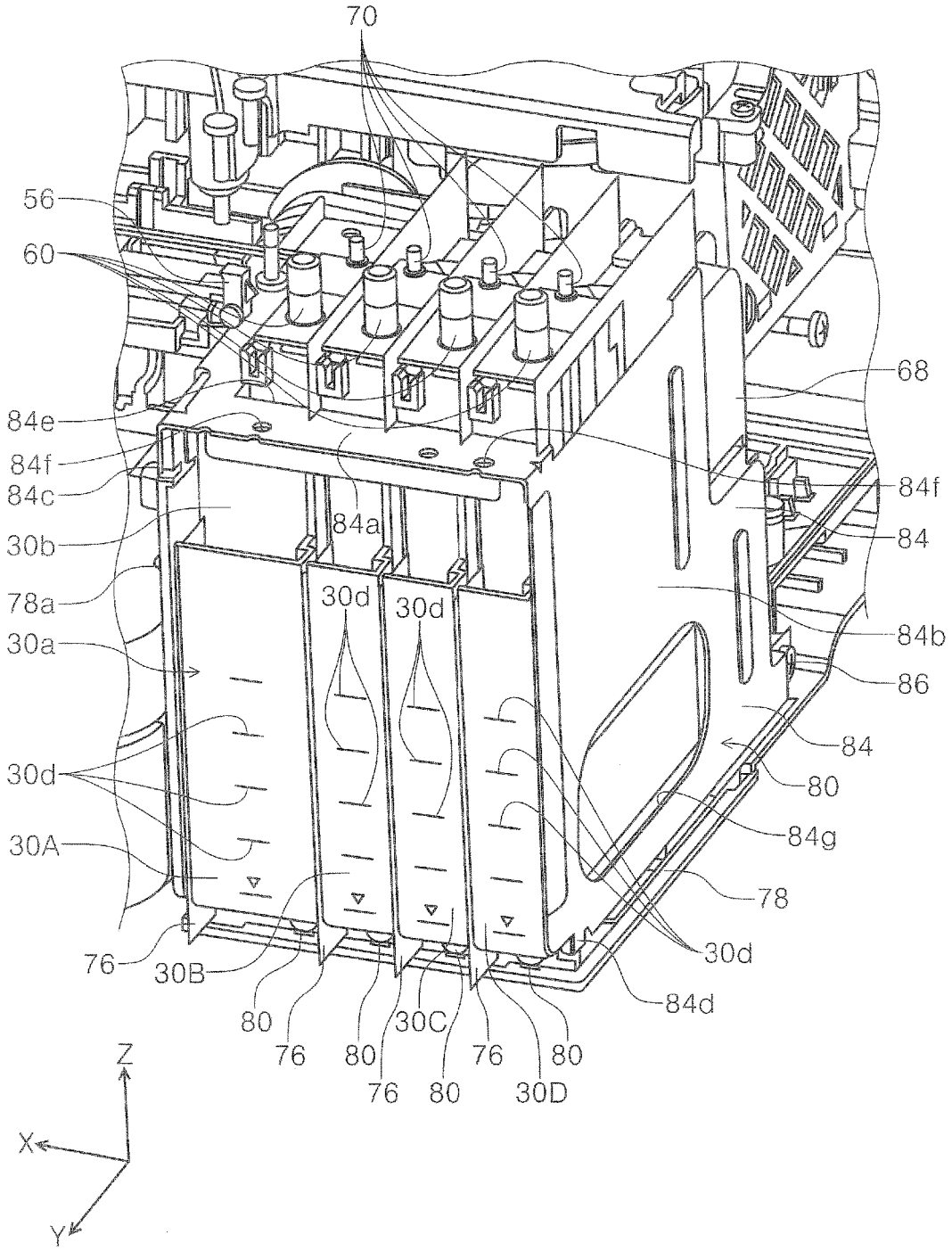
FIG. 18 is a perspective view showing the ink storage unit, with an upper housing removed.
Figure 19:
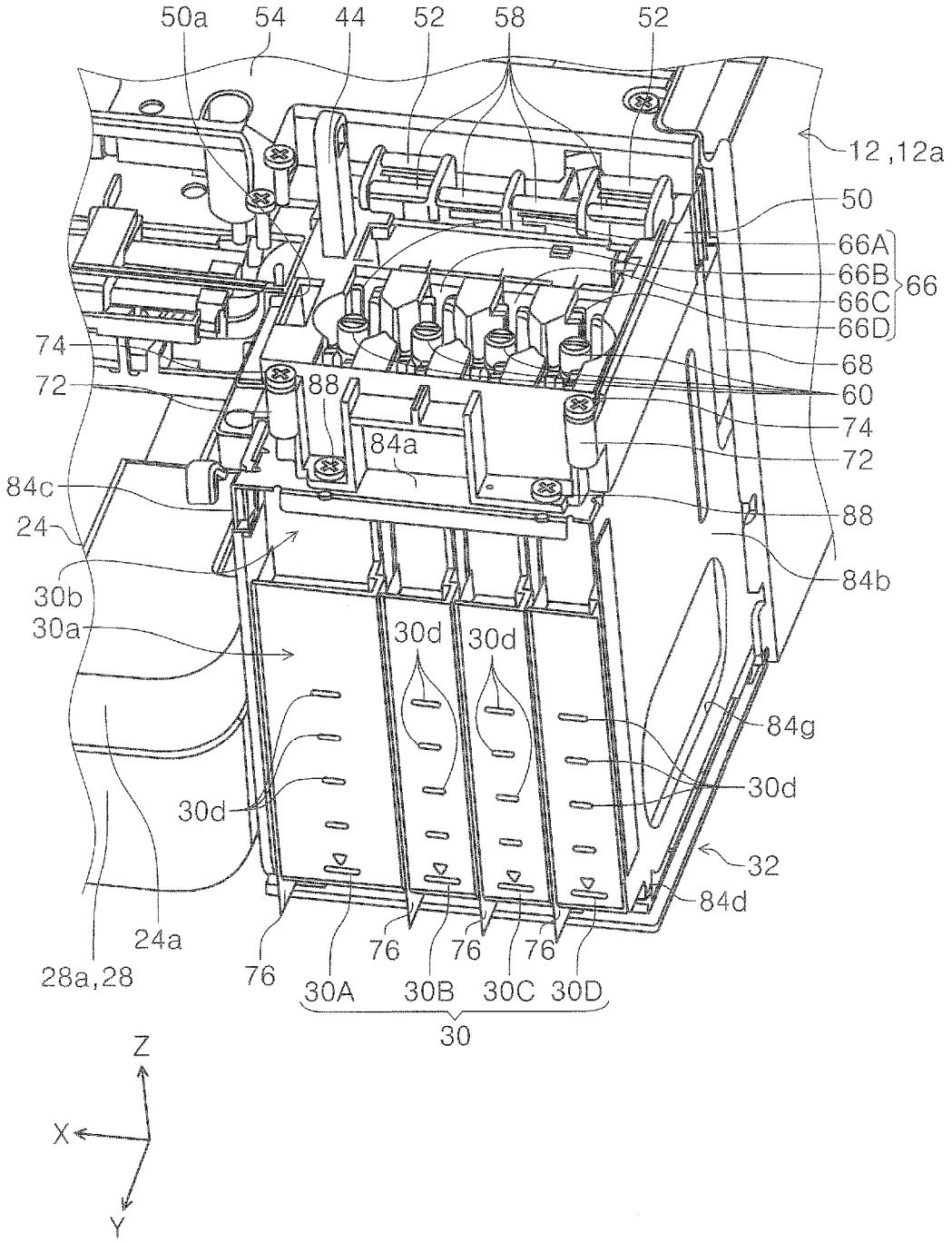
FIG. 19 is a perspective view showing the ink storage unit, with outer parts removed.
Figure 20:
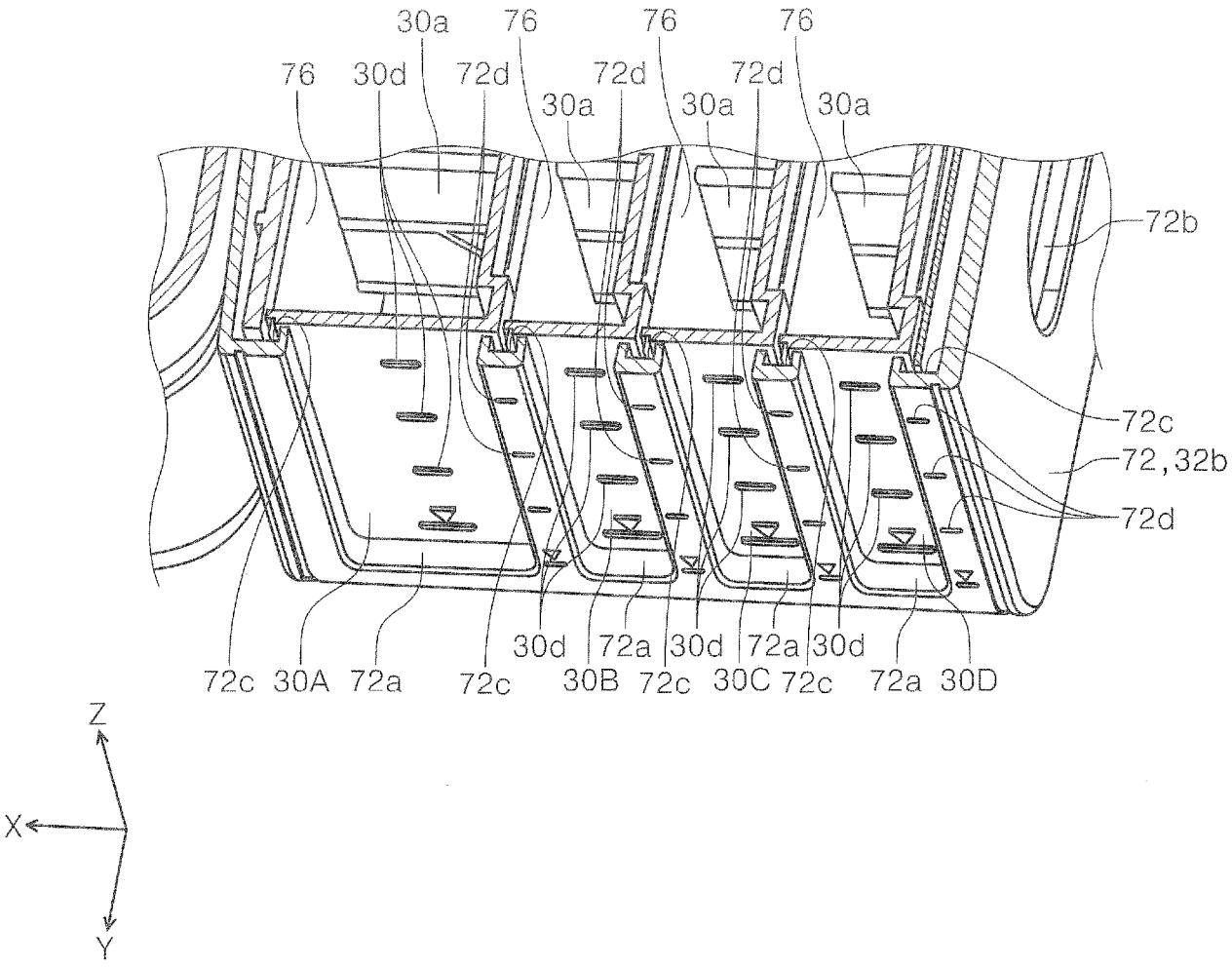
FIG. 20 is a partially cut-away perspective view showing a relationship between the ink tank and the outer parts, in the arrangement of the ink balance indicator.
Figure 21:
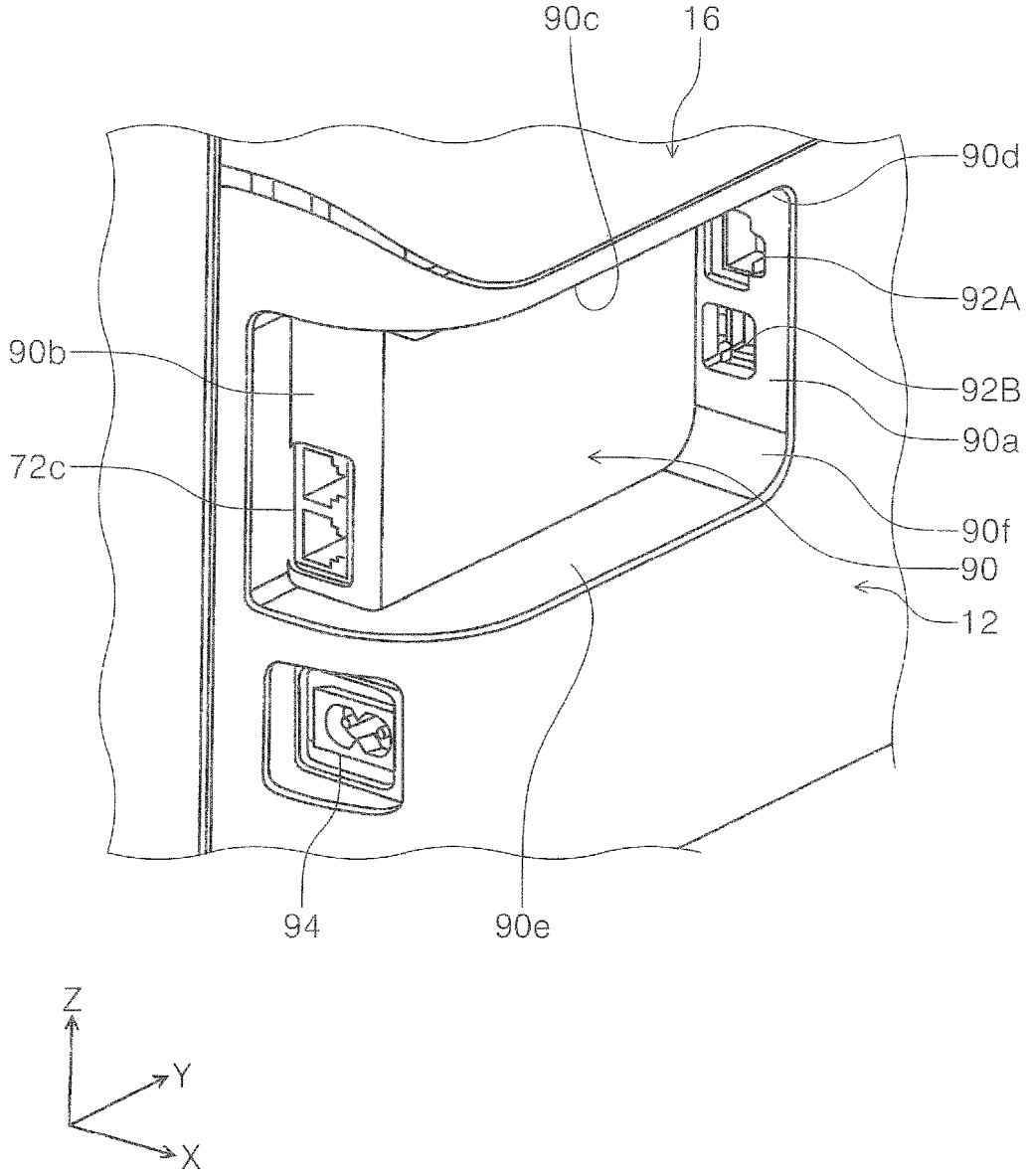
FIG. 21 is a perspective view showing an appearance of connector ports provided in the side face of the printer main body.
Figure 22:
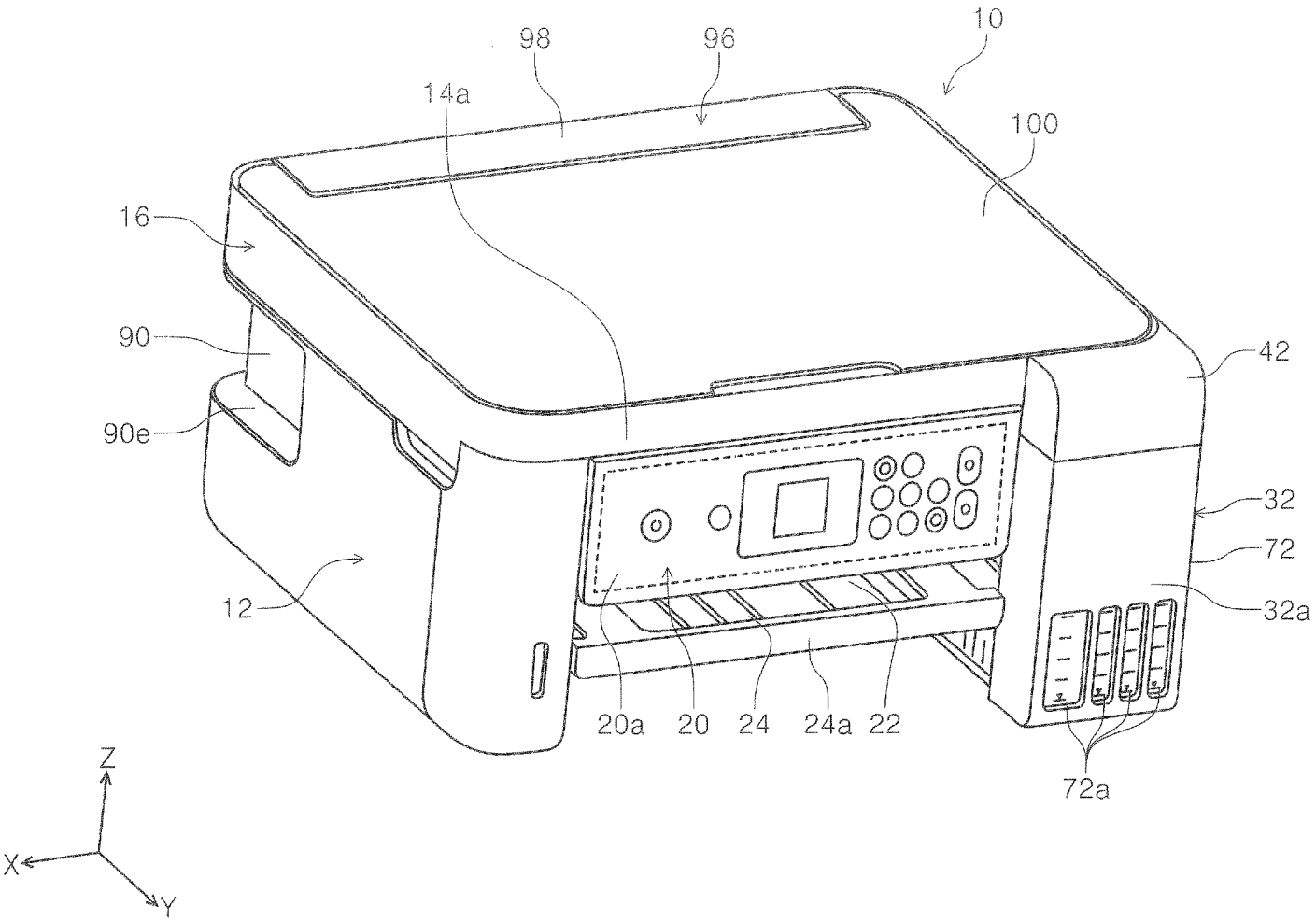
FIG. 22 is a perspective view showing an appearance of a printer according to another embodiment of the invention.

FIG. 15 is a side view of the ink tank; FIG. 16 is a perspective view showing the ink storage unit, with a reinforcing frame removed; FIG. 17 is a perspective view showing an appearance of the reinforcing frame; FIG. 18 is a perspective view showing the ink storage unit, with an upper housing removed; FIG. 19 is a perspective view showing the ink storage unit, with outer parts removed; FIG. 20 is a partially cut-away perspective view showing a relationship between the ink tank and the outer parts, in the arrangement of the ink balance indicator; FIG. 21 is a perspective view showing an appearance of connector ports provided in the side face of the printer main body; and FIG. 22 is a perspective view showing an appearance of a printer according to another embodiment of the invention.

In the X-Y-Z coordinate system indicated in each of the drawings, the X-direction corresponds to a width direction of a recording medium, in other words a width direction of the apparatus, the Y-direction corresponds to a transport direction of the recording medium along a transport route in the recording apparatus, in other words a depth direction of the apparatus, and the Z-direction corresponds to a height direction of the apparatus.

First Embodiment

Outline of Invention

A basic concept of this embodiment is locating an ink storage unit including ink tanks on a front side of the apparatus, and aligning the positions of the ink storage unit and a medium output tray or a medium storage unit in the depth direction of the apparatus, on the front side, thereby achieving good appearance and high strength.

Outline of Liquid Ejecting Apparatus

Referring to FIG. 1 and FIG. 2, a general configuration of a printer 10 according to the invention will be described. The printer 10 is set up as an ink jet printer, exemplifying the liquid ejecting apparatus. The printer 10 is a multifunction peripheral including a main body 12 and a scanner unit 14, exemplifying the image reading unit.

In this embodiment, the scanner unit 14 is pivotably connected to a rear end portion of the main body 12 in the depth direction of the apparatus, such that, though not illustrated, when the scanner unit 14 is made to pivot to the rear side of the apparatus, the upper portion of the main body 12 is exposed. The scanner unit 14 includes a scanner main body 16 and an ADF unit 18. The ADF unit 18 is, for example, pivotably connected to an upper side of the scanner main body 16, in the height direction of the apparatus. When the ADF unit 18 is made to pivot with respect to the scanner main body 16, a non-illustrated document mounting surface of the scanner main body 16 is exposed, so that a source document can be set on the document mounting surface.

The ADF unit 18 also includes a document mounting tray 18*a* and a document discharge tray 18*b*. The document mounting tray 18*a* and the document discharge tray 18*b* can be set to a closed state shown in FIG. 1 and an open state shown in FIG. 2. When the document mounting tray 18*a* and the document discharge tray 18*b* are opened, the source document mounted on the document mounting tray 18*a* can be delivered to the non-illustrated document mounting surface with a non-illustrated feeding device, so that a non-illustrated image reading device reads the image on the source document, and then discharged to the document discharge tray 18*b*.

In the closed state, the top faces of the document mounting tray 18*a* and the document discharge tray 18*b* are flat as shown in FIG. 1, so as to achieve a good appearance.

A configuration of the main body 12 will be described hereunder. An operation panel 20, which is pivotable with respect to the main body 12, is provided on the front side thereof, in the depth direction of the apparatus. The operation panel 20 includes a display section such as a display panel, and a plurality of operation buttons. The operation panel 20 can be retracted in the main body 12 (see FIG. 1 and FIG. 2), and pivoted upward from the main body 12 (see FIG. 4).

On the front side of the main body 12 in the depth direction of the apparatus, a discharge port 22 is provided under the operation panel 20 in the height direction of the apparatus. In addition, a medium output tray 24 is provided under the discharge port 22 in the height direction of the apparatus. The medium, on which recording has been performed by a recording head 26 to be subsequently described, exemplifying the liquid ejecting unit, is discharged to the medium output tray 24 through the discharge port 22.

A medium storage unit 28 is provided under the medium output tray 24, in the height direction of the apparatus. The medium storage unit 28 is detachably mounted in the main body 12 from the front side, in the depth direction of the apparatus, and configured to receive the media thereinside.

In addition, an ink storage unit 32 is provided on the front side of the main body 12 in the depth direction of the apparatus, and in a right end portion in the width direction of the apparatus. The ink storage unit 32 includes one or more ink tanks 30 for storing ink, exemplifying the liquid. Here, the ink storage unit 32 is protruding forward on the front side of the main body 12, with respect to the operation panel 20 in the retracted state, as shown in FIG. 1 and FIG. 2.

Referring to FIG. 4, the medium output tray 24 and the medium storage unit 28 are protruding forward with respect to the operation panel 20 in the retracted state, in the depth direction of the apparatus. In addition, a front face 24*a* of the medium output tray 24 and a front face 28*a* of the medium storage unit 28 are flush with a front face 32*a* of the ink storage unit 32, in the depth direction of the apparatus. In this embodiment, the expression "flush in the depth direction of the apparatus" refers not only to the case where the front face 24*a* of the medium output tray 24 and the front face 32*a* of the ink storage unit 32 are strictly at the same position in the depth direction of the apparatus, but also to the case where the mentioned front faces are generally flush with each other, with a slight deviation. Likewise, the case where the front face 28*a* of the medium storage unit 28 and the front face 32*a* of the ink storage unit 32 are generally flush with each other with a slight deviation may also be expressed as "flush". In addition, the positional relationship of other components, for example a front face 20*a* of the operation panel 20 and a front face 14*a* of the scanner unit 14, may be expressed as "flush" when these are generally flush with each other with a slight deviation. Further, as shown in FIG. 1 to FIG. 3, a side face 32*b* of the ink storage unit 32 and the side face of the apparatus, in other words a side face 12*a* of the main body 12, are flush with each other in the width direction of the apparatus.

Forming the medium output tray 24, the medium storage unit 28, and the ink storage unit 32 so as to protrude forward with respect to the operation panel 20 in the retracted state reduces, as shown in FIG. 4, the protrusion amount of the operation panel 20 from the front face 24*a* of the medium output tray 24, the front face 28*a* of the medium storage unit 28, and the front face 32*a* of the ink storage unit 32, in the depth direction of the apparatus, when the operation panel 20 is pivoted upward.

Further, as shown in FIG. 1 and FIG. 2, the front face 14*a* of the scanner unit 14 in the closed state and the front face 20*a* of the operation panel 20 in the retracted state are flush with each other, on the front side of the main body 12. In other words, the front face 14*a* of the scanner unit 14 in the closed state and the front face 20*a* of the operation panel 20 in the retracted state are flush with each other, in the depth direction of the apparatus.

Referring now to FIG. 3, a carriage 34, which is movable in the width direction of the apparatus, is provided on the rear side of the operation panel 20 and the ink storage unit 32, in the depth direction of the apparatus. The carriage 34 is made to reciprocate in the width direction of the apparatus, by a carriage driver 38 activated by driving force of a drive motor 36.

A recording head 26 is provided on the lower side of the carriage 34. Further, a medium platen 40 is located under and opposite to the recording head 26, over a region corresponding to the stroke range of the carriage 34 in the width direction of the apparatus.

The medium stored in the medium storage unit 28 is fed therefrom to the region opposing the recording head 26, by the non-illustrated feeding device. When the medium reaches the region opposing the recording head 26, the recording head 26 ejects the ink onto the opposing surface of the medium, thus to perform the recording. The medium that has reached the region opposing the recording head 26 has the surface opposite to the recording surface supported by the medium platen 40, and is transported to the downstream side in the transport direction. The medium that has undergone the recording by the recording head 26 is discharged to the medium output tray 24, through the discharge port 22.

On the rear side of the stroke range of the carriage 34, for example a control unit 41 is provided. The control unit 41 is set up as an electric circuit composed of a plurality of electronic parts. The control unit 41 is configured to control the scanner unit 14, the drive motor 36, the carriage driver 38, the carriage 34, the recording head 26, and other non-illustrated feeding device and transport device. In other words, the control unit 41 controls the operations necessary for executing the recording and image reading functions of the printer 10, such as feeding, transporting, and discharging of the medium, recording, and image reading.

The control unit 41 is electrically connected to the operation panel 20, to control the printer 10 according to inputs made by the user through the operation panel 20. The control unit 41 may also control the operations necessary for executing the recording and image reading functions of the printer 10, according to instruction from outside (e.g., a PC). The control unit 41 also controls the ejection of the ink through nozzles on the head face of the recording head 26. Further, the control unit 41 causes the display unit on the operation panel 20 to display information.

Ink Storage Unit Cover

Referring now to FIG. 5 to FIG. 10, an ink storage unit cover 42 will be described hereunder. As shown in FIG. 5 and FIG. 12, the ink storage unit cover 42 is pivotably mounted on the upper side of the ink storage unit 32. When the ink storage unit cover 42 is made to pivot to the rear side in the depth direction of the apparatus, the upper portion of the ink storage unit 32 is exposed, as show in FIG. 12.

The top face of the ink storage unit cover 42 is partially cut away along the shape of the front side and the right end portion of the scanner main body 16. On a shelf portion 42*a* of the ink storage unit cover 42, a lock device mounting base 42*b* is provided as shown in FIG. 6. In addition, an opening 42*c* is formed in the shelf portion 42*a*, at a position adjacent to the lock device mounting base 42*b*. A lock device fastener 44, projecting upward from the upper side of the ink storage unit 32 in the height direction of the apparatus, is passed through the opening 42*c*. The upper end portion of the lock device fastener 44 is sticking out upward from the opening 42*c*, in the height direction of the apparatus. In this embodiment, the opening 42*c* and the lock device fastener 44 constitutes a lock unit 46.

In addition, the lock device fastener 44 includes a through hole 44*a*, formed in the upper end portion. When a lock device 48 mounted on the lock device mounting base 42*b* is locked upon passing a hook 48*a* through the through hole 44*a* as shown in FIG. 5, the ink storage unit cover 42 is restricted from pivoting with respect to the ink storage unit 32. Here, although a padlock is employed as the lock device 48 in this embodiment, different types of lock may be employed.

Referring to FIG. 7, when the scanner main body 16 is set to cover the main body 12, with the ink storage unit cover 42 locked as shown in FIG. 5, a part of the front end portion of the scanner main body 16 is located above the lock device mounting base 42*b*, the lock unit 46, and the lock device 48. Therefore, the lock device mounting base 42*b*, the lock unit 46, and the lock device 48 are covered with the scanner main body 16.

Referring to FIG. 8 to FIG. 10, a bearing portion 42*d* is formed along the rear end portion of the ink storage unit cover 42, in the depth direction of the apparatus. A pivotal shaft 52 provided in the upper housing 50, which will be subsequently described, is fitted in the bearing portion 42*d*, as shown in FIG. 7 to FIG. 9. The pivotal shaft 52 includes flat portions 52*a*, formed by cutting away a part of the circumferential surface, to facilitate the insertion of the pivotal shaft 52 into the bearing portion 42*d*.

As shown in FIG. 10, a first retainer 42*e*, projecting to the rear side in the depth direction of the apparatus, is provided at the rear end portion of the ink storage unit cover 42 in the depth direction of the apparatus. In addition, a pin-shaped second retainer 42*f*, projecting to the left in the width direction of the apparatus, is provided at the left end portion of the ink storage unit cover 42, in the width direction of the apparatus.

In addition, the main body 12 includes a frame member 54 constituting a part thereof, and located on the rear side of the operation panel 20 and the ink storage unit 32 in the depth direction of the apparatus. The frame member 54 includes a first limiter 54*a* and a second limiter 54*b*. The first limiter 54*a* and the second limiter 54*b* are concave portions formed in the recessed frame member 54 so as to recede upward from the lower edge.

Thus, when the ink storage unit cover 42 is mounted on the ink storage unit 32, the first retainer 42*e* is fitted in the first limiter 54*a* and the second retainer 42*f* is fitted in the second limiter 54*b*, as shown in FIG. 10. When the ink storage unit cover 42 is about to be made to pivot to the open state from the closed state, the first retainer 42*e* moves in a direction to be released from the first limiter 54*a*, and the pin-shaped second retainer 42*f* rotates inside the second limiter 54*b*. Therefore, the pivoting motion of the ink storage unit cover 42 is not restricted.

Here, since the pivotal shaft 52 includes the flat portions 52*a* respectively formed on the front side and rear side in the depth direction of the apparatus as shown in FIG. 9, the pivotal shaft 52 is prone to come off from the bearing portion 42*d* of the ink storage unit cover 42, though easy to be inserted therein. However, when the ink storage unit cover 42 mounted on the ink storage unit 32 is about to be lifted upward therefrom, in the height direction of the apparatus, the first retainer 42*e* is engaged with the first limiter 54*a* as shown in FIG. 10, and hence the first limiter 54*a* restricts the displacement of the first retainer 42*e* in the height direction of the apparatus. Likewise, the second retainer 42*f* is also engaged with the second limiter 54*b*, so that the second limiter 54*b* restricts the displacement of the second retainer 42*f* in the height direction of the apparatus. Therefore, the ink storage unit cover 42 can be prevented from readily coming off from the upper housing 50, hence from the ink storage unit 32.

Further, a detection piece 42*g* sticking out downward in the height direction of the apparatus, and a rib-shaped lock lever presser 42*h* extending in the width direction of the apparatus, are provided in the lower portion of the ink storage unit cover 42.

First, the detection piece 42*g* will be described. The detection piece 42*g* is formed so as to be detected by the detection sensor 56, when the ink storage unit cover 42 is set to close the ink storage unit 32. More specifically, the upper housing 50 provided in the upper portion of the ink storage unit 32 includes an opening 50*a* oriented upward (see FIG. 11 to FIG. 13).

The detection sensor 56 is located at the position corresponding to the opening 50*a*, as shown in FIG. 18. The detection sensor 56 is, for example, an optical sensor. When the ink storage unit cover 42 is made to pivot so as to close the ink storage unit 32, and hence the detection piece 42*g* enters the opening 50*a*, the detection sensor 56 detects the detection piece 42*g*. Thus, the detection sensor 56 detects that the ink storage unit cover 42 has been set to close the ink storage unit 32.

When the detection sensor 56 detects the detection piece 42*g*, the control unit 41 resets the value of ink balance in the ink tank 30 provided in the ink storage unit 32, to an initial value. At this point, the control unit 41 calculates the ink balance in the ink tank 30, on the basis of the ink consumption through the recording head 26. The control unit 41 then resumes the calculation of the ink balance, on the assumption that the ink has been replenished in the ink tank 30, based on the detection that the ink storage unit cover 42 has been set to close the ink storage unit 32, and monitors the ink balance. For example, when the ink balance in the ink tank 30 falls below a predetermined threshold, the control unit 41 generates a display in the display unit on the operation panel 20, so as to alert the user to replenish the ink.

The lock lever presser 42*h* will now be described. Referring to FIG. 13, a pair of pivotal shafts 52, serving as the pivotal fulcrum to allow the ink storage unit cover 42 to pivot, are provided with a spacing therebetween in the width direction of the apparatus, on the rear side of the upper housing 50 in the depth direction of the apparatus. In addition, a plurality of pivotal shafts 58, in other words the same number of pivotal shafts 58 as that of ink inlet ports 60 (see FIG. 19) to be subsequently described, are provided in the width direction of the apparatus, on the front side of the pivotal shaft 52 in the depth direction of the apparatus. In FIG. 13, the ink inlet ports 60 are each covered with an ink inlet port cover 62.

Referring to FIG. 11 and FIG. 12, a lock lever 64 is attached to each of the pivotal shafts 58. The lock lever 64 is pivotable about the pivotal shaft 58 serving as the pivotal fulcrum, and can be set to a closed state (see FIG. 11) and an open state (see FIG. 12). In addition, an ink inlet port cover 62 is attached to each of the lock levers 64. When the lock lever 64 is set to close the upper housing 50, the ink inlet port cover 62 covers the ink inlet port 60, to prevent, or reduce, leakage of the ink through the ink inlet port 60.

Further, when the ink storage unit cover 42 is set to close the ink storage unit 32, the lock lever presser 42*h* is abutted against the lock levers 64 in the closed state, as shown in FIG. 7. When the lock levers 64 completely closes the upper housing 50, the ink storage unit cover 42 can be set to completely close the ink storage unit 32.

In contrast, when the lock lever 64 is floating above (i.e., not completely closing) the upper housing 50, the ink storage unit cover 42 is unable to be set to completely close the ink storage unit 32, and therefore a gap is formed between the ink storage unit cover 42 and the ink storage unit 32, which can be visually recognized. Accordingly, the user can be aware that the lock lever 64 is not completely closed. Then when the user presses the ink storage unit cover 42 in the closing direction, the lock lever presser 42*h* presses the lock lever 64 downward in the height direction of the apparatus, in other words in the direction to close the lock lever 64, thus to completely close the lock lever 64. Consequently, the ink storage unit cover 42 can be set to the completely closed state.

In addition, when the ink storage unit cover 42 is set to open the ink storage unit 32, and the lock lever 64 is made to pivot with respect to the upper housing 50 so as to open as shown in FIG. 12, the lock lever 64 is abutted against the lock lever presser 42*h*, and thus restricted from opening further beyond a predetermined angle. Therefore, the operability of the lock lever 64 can be prevented from being degraded because, for example, the lock lever 64 is restricted from pivoting over an excessive angle to the rear side in the depth direction of the apparatus, and falling into inside the ink storage unit cover 42, to make it difficult for the user to pick up the lock lever 64.

Ink Inlet Port and Air Release Port

Referring now to FIG. 13 and FIG. 19, mislocation prevention devices 66A, 66B, 66C, and 66D (hereinafter, simply mislocation prevention device 66, when such individual distinction is unnecessary) are provided in the upper housing 50, according to the number of ink inlet ports 60 of the ink tanks 30. The mislocation prevention device 66 is a slot-shaped recess formed on the upper side of the upper housing 50, so as to surround the ink inlet port 60. In each of the mislocation prevention devices 66A, 66B, 66C, and 66D, a protrusion or a recess is formed at a certain position, and the position of such protrusion or recess is different in each of the mislocation prevention devices 66A, 66B, 66C, and 66D.

In addition, though not illustrated, an ink supply container, exemplifying the liquid supply container that replenishes the ink in the ink tank 30, is attached to the mislocation prevention device 66, so that the ink is replenished in the ink tank 30 through the ink inlet port 60. In this embodiment, the ink storage unit 32 includes four ink tanks 30A, 30B, 30C, and 30D, according to the colors of the ink to be stored. For example, black ink, cyan ink, magenta ink, and yellow ink are stored in the ink tanks 30A to 30D, respectively. In this embodiment, the ink tank 30A has a larger capacity than the remaining ink tanks 30B, 30C, and 30D.

Further, for example, the mislocation prevention device 66A corresponds to the ink tank 30A, the mislocation prevention device 66B corresponds to the ink tank 30B, the mislocation prevention device 66C corresponds to the ink tank 30C, and the mislocation prevention device 66D corresponds to the ink tank 30D.

For each of the ink tanks 30A, 30B, 30C, and 30D, the ink supply container that replenishes the ink of the corresponding color is provided. The ink supply containers each include a mounting device that fits the shape of the mislocation prevention device 66A, 66B, 66C, or 66D, corresponding to the ink tank 30A, 30B, 30C, or 30D. For example, even though the user attempts to attach the mounting device of the ink supply container corresponding to the ink tank 30A to any of the mislocation prevention devices 66B, 66C, and 66D, the shape of the mounting device and the shape of the mislocation prevention device 66B, 66C, or 66D do not fit each other, and hence the ink supply container for the ink tank 30A is unable to be attached to other ink tanks.

In other words, the ink supply container for one of the ink tanks 30A, 30B, 30C, and 30D can only be attached to the mislocation prevention device 66 of the corresponding ink tank 30, and therefore the ink supply container can be prevented from being attached to a wrong ink tank, and thus the ink of a different color can be prevented from being supplied to the ink tank 30.

In addition, the upper housing 50 includes air release ports 70A, 70B, 70C, and 70D of a buffer section 68, which will be subsequently described, between the mislocation prevention device 66 and the pivotal shaft 58, in the depth direction of the apparatus.

Referring to FIG. 13, the ink inlet ports 60 are located between the front face 32*a* of the ink storage unit 32 and the upper edge 20*b* of the operation panel 20, in the depth direction of the apparatus. The opening 50*a* and the detection sensor 56 (see FIG. 18) are located outside the region where the ink inlet ports 60 and the air release ports 70 are provided, in the width direction of the apparatus.

Configuration of Ink Storage Unit

Referring to FIG. 11 to FIG. 20, the ink storage unit 32 will be described in further detail. As shown in FIG. 11, the ink storage unit 32 includes an outer housing 72 that covers at least the right and left face in the width direction of the apparatus and the front face in the depth direction of the apparatus. The outer housing 72 is fastened, as shown in FIG. 13 and FIG. 19, at two mounting positions provided on the front side of the upper housing 50 in the depth direction of the apparatus, with a fastening device 74. The fastening device 74 may be, for example, a screw.

Referring to FIG. 11 and FIG. 14, the outer housing 72 includes a plurality of openings 72*a*, formed in the front face in the depth direction of the apparatus. The openings 72*a* are formed so as to respectively correspond to the ink tanks 30A, 30B, 30C, and 30D, aligned in the width direction of the apparatus. The openings 72*a* each extend in the height direction of the apparatus. Accordingly, the user can view the ink tanks 30A, 30B, 30C, and 30D through the openings 72*a*, from the front side in the depth direction of the apparatus.

Referring now to FIG. 15, the ink tank 30 includes an ink storage chamber 30*a* located in the lower portion in the height direction of the apparatus and extending in the depth direction of the apparatus, and an ink inlet portion 30*b* projecting upward in the height direction of the apparatus from the ink storage chamber 30*a*. The ink inlet port 60 is located on the upper side of the ink inlet portion 30*b*. In addition, a fastening portion 30*c* is provided in the bottom portion of the ink storage chamber 30*a*. In this embodiment, the left face of the ink storage chamber 30*a* in the width direction of the apparatus is opened. A film material 76 is press-bonded to the left face of the ink storage chamber 30*a* so as to cover the opening, thus to tightly seal the ink storage chamber 30*a*. The film material 76 is press-bonded so as to protrude outward from the ink storage chamber 30*a*.

In this embodiment, the front side of the ink tank 30 in the depth direction of the apparatus is configured so as to allow the user to visually recognize the ink balance in the ink tank. More specifically, the ink tank 30 is formed of a transparent or semitransparent material. In addition, scales 30*d* of a rib shape or groove shape are marked on the front face of the ink tank 30, to enable the user to confirm the amount of the ink balance.

As shown in FIG. 14, the outer housing 72 includes scales 72*d* of a rib shape or groove shape, formed in the region corresponding to the opening 72*a* on the front side in the depth direction of the apparatus, in alignment with the scales of the ink tank 30 in the height direction of the apparatus. Further, scales 72*e* of a rib shape or groove shape are marked beside the opening 72*a*, in alignment with the scales of the ink tank 30 in the height direction of the apparatus.

Forming thus the scales 72*e* of the rib shape or groove shape beside the opening 72*a* in alignment with the scales of the ink tank 30 in the height direction of the apparatus, in addition to the scales on the front side of the outer housing 72, allows the user to collectively view the scales 30*d* on the ink tank 30 and the scales 72*e* beside the opening 72*a* at a time, when the user views the ink tank 30 from a position shifted in the width direction of the apparatus, instead of from a position in front of the ink storage unit 32. Therefore, the user can recognize the ink balance in the ink tank 30, with higher accuracy.

Further, the outer housing 72 includes an opening 72*b* (see FIG. 20) formed in the right face in the width direction of the apparatus. The opening 72*b* extends in the depth direction of the apparatus. Accordingly, the user can view the side face of the ink tank 30D, through the opening 72*b*. Thus, the user can view not only the front face but also the side face of the ink tank 30, and therefore can not only confirm the ink balance in the ink tank 30, but also intuitively recognize, upon replenishing the ink in the ink tank 30, the amount of the ink that has been replenished.

Referring now to FIG. 16, a lower frame 78 constituting a part of the bottom portion of the main body 12 serves as the base of a storage compartment 80 in which the ink tanks 30 are accommodated. In addition, a part of the lower frame 78, on the left end portion of the storage compartment 80 in the width direction of the apparatus, is erected upward in the height direction of the apparatus, so as to form a left-hand inner wall 78*a* of the storage compartment 80, in the width direction of the apparatus. To the lower frame 78, the ink tanks 30A, 30B, 30C, and 30D are fastened with a fastening device provided at the fastening portion 30*c* of the ink tank 30. For example, the ink tanks 30 are mounted on the lower frame 78 such that the ink tanks 30A, 30B, 30C, and 30D are aligned in this order from the left to the right in the width direction of the apparatus. In this embodiment, the fastening device may be a screw.

Further, a plurality of buffer sections 68 (see also FIG. 3) are provided on the upper side of the ink storage chamber 30*a* of the ink tank 30 in the height direction of the apparatus, and on the rear side of the ink inlet portion 30*b* in the depth direction of the apparatus. The buffer sections 68 are respectively provided for the ink tanks 30A, 30B, 30C, and 30D. The buffer sections 68 are respectively connected to the ink tanks 30A, 30B, 30C, and 30D. In the case where, for example, the temperature around the printer 10 rises, the air pressure in the ink tank 30 increases if the ink inlet port 60 is closed by the ink inlet port cover 62, and therefore the ink stored in the ink tank 30 may be squeezed out into the buffer section 68.

For example, the buffer sections 68 are each given an ink storage capacity that is generally the same as or larger than that of the corresponding ink tank 30. Accordingly, the ink that has flowed into the buffer section 68 from the ink tank 30 can be prevented from leaking out of the buffer section 68. When the temperature around the printer 10 falls and the air pressure in the ink tank 30 decreases, the ink squeezed out into the buffer section 68 returns to the ink tank 30.

FIG. 17 illustrates a reinforcing frame 84. The reinforcing frame 84 is, for example, formed of a metal material. The reinforcing frame 84 includes a top face 84*a* and an inner wall 84*b*. The top face 84*a* constitutes the top face of the storage compartment 80 of the ink storage unit 32, and the inner wall 84*b* constitutes the right-hand inner wall of the storage compartment 80 of the ink storage unit 32, in the width direction of the apparatus. The top face 84*a* includes a hook 84*c*, and the inner wall 84*b* includes a hook 84*d*. The hooks 84*c* and 84*d* are engaged with the lower frame 78, when the reinforcing frame 84 is mounted on the lower frame 78.

The top face 84*a* also includes an opening 84*e*. Further, the top face 84*a* includes a plurality of, for example four, fastening portions 84*f*. The inner wall 84*b* includes an opening 84*g*. The opening 84*g* is formed in the position corresponding to the opening 72*b* of the outer housing 72, and in the size corresponding to the opening 72*b*.

As shown in FIG. 18, the reinforcing frame 84 is mounted on the lower frame 78, by engaging the hook 84*c* with the inner wall 78*a* of the storage compartment 80, and engaging the hook 84*d* with the lower frame 78 serving as the base of the storage compartment 80. The rear end portion of the reinforcing frame 84 in the depth direction of the apparatus is fastened to the lower frame 78 with a fastening device 86. In this embodiment, the fastening device 86 may be a screw.

When the reinforcing frame 84 is mounted on the lower frame 78, the respective ink inlet portion 30*b* of the ink tanks 30A, 30B, 30C, and 30D stick out upward in the height direction of the apparatus, from the opening 84*e* of the reinforcing frame 84. When the reinforcing frame 84 is mounted on the lower frame 78, the ink tanks 30A, 30B, 30C, and 30D are held between the inner wall 78*a* and the inner wall 84*b* constituting the storage compartment 80, and therefore the ink tanks 30 can be fixed to the storage compartment 80, with increased strength.

Referring now to FIG. 19, the upper housing 50 is attached to the top face 84*a* of the reinforcing frame 84, so as to cover the ink inlet portion 30*b* of the ink tank 30. More specifically, the upper housing 50 is fastened to the fastening portions 84*f* in the top face 84*a*, with fastening devices 88. In this embodiment, the fastening device 88 may be a screw.

When the upper housing 50 is attached to the top face 84*a*, the ink inlet port 60 sticks out into the slot-shaped mislocation prevention device 66 provided for each ink tank 30, and is exposed in the mislocation prevention device 66. Since the upper housing 50 attached to the top face 84*a* defines the position of the ink inlet portion 30*b* of the ink tank 30, the ink tank 30 can be fixed to the storage compartment 80 with increased strength, via the upper housing 50 and the reinforcing frame 84.

Here, in each of the ink tanks 30A, 30B, 30C, and 30D fixed to the storage compartment 80 as shown in FIG. 19, a part of the film material 76 protrudes to the front side in the depth direction of the apparatus. Accordingly, as shown in FIG. 20, the outer housing 72 includes a plurality of slits 72*c*, formed on the rear side of the front face in the depth direction of the apparatus, so as to receive the excess of the film material 76. The slits 72*c* extend in the height direction of the apparatus, and are located so as to correspond to the film material 76 of each of the ink tanks 30A, 30B, 30C, and 30D, in the width direction of the apparatus.

Connector Port

Referring now to FIG. 21, the printer 10 includes a cavity 90 formed in the left face of the main body 12 in the width direction of the apparatus. A plurality of connector ports 92A, 92B, and 92C are provided in the cavity 90. More specifically, a first connector port 92A and a second connector port 92B are provided in a wall 90*a* on the front end of the cavity 90 in the depth direction of the apparatus. For example, the first connector port 92A serves as a connector port for a LAN cable, and the second connector port 92B serves as a connector port for a USB cable.

In addition, a third connector port 92C is provided in a wall 90*b* in a rear portion of the cavity 90 in the depth direction of the apparatus. For example, the third connector port 92C serves as a connector port for a FAX cable. Further, an inlet 94 for connecting a power cable is provided in the rear end portion of the main body 12 and under the cavity 90, and more particularly under the third connector port 92C.

Referring again to FIG. 4, a boundary 90*d* between a ceiling portion 90*c* and the wall 90*a* of the cavity 90 is formed in a curved shape. A boundary 90*f* between a bottom portion 90*e* and the wall 90*a* of the cavity 90 is also formed in a curved shape. In this embodiment, the boundaries 90*d* and 90*f* are formed in the curved shape, and therefore dust or trash is less likely to accumulate, compared with a corner of the right angle. Consequently, the cavity 90 is not only easier to clean, but also contributes to maintain the good appearance of the printer 10.

Variations

Although the ink storage unit cover 4 includes the bearing portion 42*d*, and the upper housing 50 includes the pivotal shaft 52 for the ink storage unit cover 42 in this embodiment, the ink storage unit cover 42 may instead include a pivotal shaft and the upper housing 50 may include a bearing portion.

Although the upper housing 50 includes the pivotal shaft 58 for the lock lever 64 in this embodiment, the lock lever 64 may instead include a pivotal shaft, and the upper housing 50 may include a bearing portion.

Although the medium storage unit 28 is provided in the lower portion of the main body 12 in this embodiment, so as to feed the medium from the medium storage unit 28 to the recording head 26 with a non-illustrated feeding device, a feeding unit 96 may be provided on the rear side of the main body 12 as shown in FIG. 22, instead of providing the medium storage unit 28 in the lower portion of the main body 12. More specifically, a feeding port cover 98 may be provided on the rear side of the main body 12 so as to pivot with respect thereto, and the medium may be delivered to the recording head 26 from a non-illustrated feeding port, which appears when the feeding port cover 98 is opened. Here, in the variation shown in FIG. 22, a scanner cover 100 for opening and closing the document mounting surface of the scanner main body 16 is provided, in place of the ADF unit 18.

As described thus far, the printer 10 includes the recording head 26 that ejects ink to the medium, the ink storage unit 32 including at least one ink tank 30 for storing the ink and located on the front side of the apparatus, the operation panel 20 through which operations are inputted, and the medium output tray 24 located on the front side of the apparatus to receive the medium discharged. The ink storage unit 32 and the medium output tray 24 are both protruding forward with respect to the operation panel 20, and the front face 32*a* of the ink storage unit 32 and the front face 24*a* of the medium output tray 24 are flush with each other. The mentioned configuration provides both better appearance and higher strength, compared with the case where only one of the ink storage unit 32 and the medium output tray 24 is protruding with respect to the other.

The printer 10 includes the recording head 26 that ejects ink to the medium, the ink storage unit 32 including at least one ink tank 30 for storing the ink and located on the front side of the apparatus, the operation panel 20 through which operations are inputted, and the medium storage unit 28 configured to receive the medium from the front side of the apparatus. The ink storage unit 32 and the medium storage unit 28 are both protruding forward with respect to the operation panel 20, and the front face 32*a* of the ink storage unit 32 and the front face 28*a* of the medium storage unit 28 are flush with each other. The mentioned configuration provides both better appearance and higher strength, compared with the case where only one of the ink storage unit 32 and the medium storage unit 28 is protruding with respect to the other.

The ink storage unit 32 includes the pivotal ink storage unit cover 42 that opens and closes at least a part of the ink tank 30, the lock unit 46 that locks the ink storage unit cover 42 with the lock device 48 when the ink storage unit cover 42 is closed, and the lock device mounting base 42*b* on which the lock device 48 is mounted. The mentioned configuration allows the ink storage unit cover 42 to be locked in the closed state, thereby preventing an accidental access to the ink tank 30.

The printer 10 further includes the scanner unit 14 configured to read an image and located on the upper side of the main body 12 including the recording head 26. The scanner unit 14 is located so as to open and close the upper side of the main body 12, and cover the lock device mounting base 42*b* in the closed state. The mentioned configuration allows the lock device 48 to be hidden when the scanner unit 14 is closed, thereby improving the appearance of the printer 10.

The ink tank 30 includes the ink inlet port 60 through which the ink can be received from the ink supply container. The ink storage unit 32 includes the plurality of ink tanks 30, the upper housing 50 provided on the upper side of the ink tanks 30 so as to expose the ink inlet port 60, and the pivotal ink storage unit cover 42 that opens and closes the upper side of the upper housing 50. The upper housing 50 delimits the upper position of the ink tank 30, and includes the mislocation prevention device 66 that prevents mislocation of the liquid supply container on the corresponding one of the plurality of ink inlet ports 60, and a pivotal shaft 52 of the ink storage unit cover 42.

With the mentioned configuration, the upper housing 50 provided on the upper side of the ink storage unit 32 serves to delimit the upper position of the ink tank 30, prevents the mislocation of the ink supply container on the corresponding one of the plurality of ink inlet ports 60, and also serves as the pivotal shaft 52 of the ink storage unit cover 42. Thus, the mentioned functions can be realized by a single component, which leads to reduction in number of parts, hence to reduction in cost.

The bottom portion of the storage compartment 80, in which the ink tanks 30 are accommodated in the ink storage unit 32, is constituted of the lower frame 78, to which the bottom portion of the ink tank 30 is fixed, and at least one inner wall 84*b* and at least one top face 84*a* of the storage compartment 80 are constituted of the reinforcing frame 84, the lower portion of which is fixed to the lower frame 78. The upper housing 50 is fixed to the reinforcing frame 84 via the bottom portion. With the mentioned configuration, the reinforcing frame 84 contributes to improving the rigidity of the ink storage unit 32, and allows the upper housing 50 to be more securely fixed.

The ink tank 30 includes the ink inlet port 60 through which the ink can be received from the ink supply container, and the ink inlet port 60 is located between the front face 32*a* of the ink storage unit 32 and at least the upper edge 20*b* of the operation panel 20, in the depth direction of the apparatus.

The ink tank 30 includes the ink inlet port 60 through which the ink can be received from the ink supply container, and the ink storage unit 32 includes the air release port 70 provided in the buffer section 68 connected to the ink tank 30, the pivotal ink storage unit cover 42 that opens and closes the upper side of the ink inlet port 60 and the air release port 70, and the detection sensor 56 that detects the opening and closing of the ink storage unit cover 42. The detection sensor 56 is located outside the region where the ink inlet port 60 and the air release port 70 are provided.

The printer 10 further includes the scanner unit 14 configured to read an image and located on the upper side of the main body 12 including the recording head 26. The front face 14*a* of the scanner unit 14 and the front face 20*a* of the operation panel 20 are flush with each other, when the scanner unit 14 is closed. Therefore, the appearance of the printer 10 can be further improved.

Further, the scanner unit 14 has a flat top face as shown in FIG. 1, and therefore the appearance of the multifunction peripheral including the printer 10 and the scanner unit 14 can be improved.

The side face 32*b* of the ink storage unit 32 and the side face 12*a* of the main body 12 are flush with each other.

Further, the ink storage unit 32 and the ink storage unit cover 42 according to the invention are applied to the ink jet printer exemplifying the recording apparatus, in the foregoing embodiment. However, the ink storage unit 32 and the ink storage unit cover 42 are broadly applicable to different types of liquid ejecting apparatuses.

The liquid ejecting apparatus herein referred to includes, without limitation to the recording apparatus such as a printer, a copier, or a facsimile machine, configured to eject the ink from an ink jet recording head to thereby perform the recording on a recording medium, those apparatuses configured to eject a liquid selected for the specific purpose, instead of the ink, from a liquid ejecting head corresponding to the ink jet recording head onto a recording medium, to thereby stick the liquid to the recording medium.

Examples of the liquid ejecting head to which the invention is applicable include, in addition to the mentioned recording head, a color material ejecting head used for manufacturing color filters of liquid crystal displays, an electrode material (conductive paste) ejecting head used for manufacturing electrodes for organic electro luminescence (EL) displays and field emission displays (FED), a bioorganic substance ejecting head used for manufacturing biochips, and a micropipette used for ejecting a specimen.

It is a matter of course that the present invention is not limited to the foregoing embodiment, but may be modified in various manners within the scope defined by the appended claims, and that such modifications are included in the present invention.

The entire disclosure of Japanese Patent Application No. 2016-254016, filed Dec. 27, 2016 is expressly incorporated by reference herein.

What is claimed is:

1. A liquid ejecting apparatus comprising:

a liquid ejecting unit that ejects a liquid to a medium;

a main body in which the liquid ejecting unit is accommodated;

a liquid storage unit including at least one liquid container for storing the liquid and located on a front side of the apparatus;

an operation panel through which operations are inputted, the operation panel being located on the front side of the apparatus and configured to be retracted and pivoted upward; and a stretchable medium output tray located on the front side of the apparatus, to receive the medium discharged, wherein the liquid storage unit and the medium output tray are both protruding forward with respect to the operation panel, when the operation panel and the medium output tray are retracted in the main body, wherein a front face of the liquid storage unit and a forward end portion of the medium output tray are flush with each other in a depth direction of the liquid ejecting apparatus, when the medium output tray is accommodated in the main body, wherein the liquid container includes a liquid inlet port through which the liquid can be received from a liquid supply container, and wherein the liquid inlet port is located between a front face of the liquid storage unit and a front face of the operation panel, in a depth direction of the apparatus, when the operation panel is retracted.

2. The liquid ejecting apparatus according to claim 1, wherein the liquid storage unit includes:

a pivotal cover that opens and closes at least a part of the liquid container;

a lock unit that locks the cover with a lock device when the cover is closed; and a lock device mounting base on which the lock device is mounted.

3. The liquid ejecting apparatus according to claim 2, further comprising an image reading unit configured to read an image and located on an upper side of a main body including the liquid ejecting unit, wherein the image reading unit is located so as to open and close the upper side of the main body, and cover the lock device mounting base in a closed state.

4. The liquid ejecting apparatus according to claim 1, wherein the liquid storage unit includes:

a plurality of the liquid containers;

an upper housing provided on an upper side of the liquid container; and a pivotal cover that opens and closes an upper side of the upper housing, and the upper housing delimits an upper position of the liquid container, and includes a mislocation prevention device that prevents mislocation of the liquid supply container on a corresponding one of a plurality of the liquid inlet ports, and a pivotal shaft of the cover.

5. The liquid ejecting apparatus according to claim 4, further comprising:

a lower frame forming a part of a bottom portion of the main body; and a reinforcing frame constituting a top face and an inner wall of the storage compartment, wherein the lower frame constituting a bottom portion of a storage compartment in which the liquid container is accommodated in the liquid storage unit, and the top face and the upper housing are fixed to each other, and the reinforcing frame and the lower frame are fixed to each other.

6. The liquid ejecting apparatus according to claim 1, wherein the liquid storage unit includes:

an air release port provided in a buffer section connected to the liquid container;

a pivotal cover that opens and closes an upper side of the liquid inlet port and the air release port; and a detector that detects the opening and closing of the cover, and the detector is located outside a region where the liquid inlet port and the air release port are provided.

7. The liquid ejecting apparatus according to claim 1, further comprising an image reading unit configured to read an image and located on an upper side of the main body including the liquid ejecting unit, wherein a front face of the image reading unit and a front face of the operation panel are flush with each other, when the image reading unit is closed.

8. The liquid ejecting apparatus according to claim 1, wherein a side face of the liquid storage unit and a side face of the liquid ejecting apparatus are flush with each other.

9. The liquid ejecting apparatus according to claim 1, wherein the operation panel is located to a side of a portion of the liquid storage unit.

10. A liquid ejecting apparatus comprising:

a liquid ejecting unit that ejects a liquid to a medium;

a main body in which the liquid ejecting unit is accommodated;

a liquid storage unit including at least one liquid container for storing the liquid and located on a front side of the apparatus;

an operation panel through which operations are inputted, the operation panel being located on the front side of the apparatus and configured to be retracted and pivoted upward; and a medium storage unit configured to receive the medium from the front side of the apparatus, wherein the liquid storage unit and the medium storage unit are both protruding forward with respect to the operation panel, when the operation panel is retracted, wherein a front face of the liquid storage unit and a front face of the medium storage unit are flush with each other in a depth direction of the liquid ejecting apparatus.

11. The liquid ejecting apparatus according to claim 10, wherein the operation panel is located to a side of a portion of the liquid storage unit.

* * * * *